US005580341A

United States Patent [19]

Simonson

[11] Patent Number: 5,580,341

[45] Date of Patent: Dec. 3, 1996

[54] SHOULDER PRESS EXERCISE MACHINE AND METHOD OF EXERCISING

[75] Inventor: Roy Simonson, Colorado Springs, Colo.

[73] Assignee: Lumex, Inc.

[21] Appl. No.: 399,136

[22] Filed: Mar. 6, 1995

Related U.S. Application Data

[63] Continuation-in-part of Ser. No. 396,670, Mar. 1, 1995.

[51] Int. Cl.[6] ..... A63B 21/06; A63B 23/02

[52] U.S. Cl. ..... 482/100; 482/97; 482/101; 482/126; 482/127; 482/130; 482/134; 482/136; 482/137; 482/139; 482/908

[58] Field of Search ..... 782/98–103, 133–139, 782/142, 907, 97, 126, 127, 130, 908; 601/33; 254/403, 411, 415

[56] References Cited

U.S. PATENT DOCUMENTS

| | | | |
|---|---|---|---|
| Re. 34,572 | 3/1994 | Johnson et al. . | |
| Re. 34,577 | 4/1994 | Habing et al. . | |
| D. 239,303 | 3/1976 | Clarke . | |
| D. 289,783 | 5/1987 | Pappinen . | |
| D. 321,025 | 10/1991 | Jones . | |
| D. 321,027 | 10/1991 | Jones . | |
| D. 321,028 | 10/1991 | Jones . | |
| D. 324,710 | 3/1992 | Habing . | |
| 799,270 | 9/1905 | Roland | 482/97 |
| 931,699 | 8/1909 | Medart . | |
| 1,052,962 | 2/1913 | Reach . | |
| 1,535,391 | 4/1925 | Anderson . | |
| 1,703,104 | 2/1929 | Hassler . | |

(List continued on next page.)

FOREIGN PATENT DOCUMENTS

| | | | |
|---|---|---|---|
| 1257091 | 2/1961 | France | 601/24 |
| 2581550 | 11/1986 | France . | |
| 2612406 | 9/1988 | France | 482/100 |
| 220034 | 3/1910 | Germany . | |
| 3140859A1 | 10/1981 | Germany . | |
| 3423837A1 | 1/1986 | Germany . | |
| 635999 | 12/1978 | U.S.S.R. . | |
| 1258442 | 9/1986 | U.S.S.R. . | |
| 1745271A1 | 1/1990 | U.S.S.R. . | |
| 626 | of 1871 | United Kingdom | 254/415 |
| 925678 | 5/1963 | United Kingdom . | |
| 2232089 | 5/1990 | United Kingdom . | |
| WO85/01446 | 4/1985 | WIPO . | |
| 91/12854 | 9/1991 | WIPO . | |
| 94/02213 | 2/1994 | WIPO . | |

OTHER PUBLICATIONS

Cybex Div. of Lumex, Inc. "Cybex Strength Systems, Service and Parts Manual," pp. 16–19, 1992.

Nautilus Sports/Medical Industries, Inc., "Machine Operating Manual: Instructions for use, Maintenance Tips, Warranties, Parts", Brochure, pp. 13–16, 27 & 28.

(List continued on next page.)

*Primary Examiner*—Richard J. Apley
*Assistant Examiner*—Victor K. Hwang

[57] ABSTRACT

An apparatus and a method for performing a shoulder press exercise are disclosed. A user support and a primary hinge are mounted to a frame. A secondary hinge is mounted to the primary hinge. An arm mounted to the secondary hinge has a handle adapted to be grasped by the user. The two hinges permit the user to displace the handle in either or both the longitudinal and lateral directions. A means for resisting the displacement of the handle, preferably in both the lateral and longitudinal directions, is provided. The resistance means may include an incremental weight stack operably engaged to handle by belts directed by self-aligning pulleys. A second handle, arm and secondary hinge may be provided for the other hand so that the user may exercise both halves of his body. The arms may be connected such that both handles move the same longitudinal and/or lateral distance. To use the exercise machine, a user selects a weight for exercise, sits on the user support, grasps the handle and pushes upward from his shoulders, moving the handle longitudinally and laterally as he so chooses, overcoming the resistance.

28 Claims, 19 Drawing Sheets

U.S. PATENT DOCUMENTS 2,356,260 8/1944 Maxwell ..... 482/97
2,921,791 1/1960 Berne ..... 482/97
2,977,120 3/1961 Morris ..... 482/103
3,381,958 5/1968 Gulland .
3,428,311 2/1969 Mitchell .
3,465,592 9/1969 Perrine .
3,558,130 1/1971 Anderson .
3,587,319 6/1971 Andrews .
3,640,527 2/1972 Proctor .
3,707,285 12/1972 Martin .
3,759,512 9/1973 Yount et al. .
3,803,350 4/1974 Williams .
3,912,261 10/1975 Lambert, Sr. .
3,912,264 10/1975 Busse et al. .
4,035,040 7/1977 Yarris .
4,050,310 9/1977 Keiser .
4,082,267 4/1978 Flavell .
4,111,414 9/1978 Roberts .
4,149,714 4/1979 Lambert, Jr. .
4,184,678 1/1980 Flavell et al. .
4,235,437 11/1980 Ruis et al. .
4,257,590 3/1981 Sullivan et al. .
4,257,592 3/1981 Jones .
4,257,593 3/1981 Keiser .
4,290,597 9/1981 Schleffendorf .
4,305,572 12/1981 Elliot ..... 254/415
4,311,305 1/1982 Lambert, Jr. et al. .
4,314,697 2/1982 Brumfield et al. .
4,357,010 11/1982 Telle .
4,358,105 11/1982 Sweeney, Jr. .
4,403,773 9/1983 Swann .
4,411,424 10/1983 Barnett .
4,445,684 5/1984 Ruff ..... 482/907
4,465,274 8/1984 Davenport .
4,482,152 11/1984 Wolff .
4,494,751 1/1985 Schnell .
4,505,475 3/1985 Olchansky et al. .
4,556,216 12/1985 Pitkanen .
4,603,855 8/1986 Sebelle .
4,603,856 8/1986 Fiore .
4,621,810 11/1986 Cummins .
4,624,457 11/1986 Silberman et al. .
4,629,185 12/1986 Amann .
4,632,392 12/1986 Peyton et al. .
4,634,127 1/1987 Rockwell .
4,684,126 8/1987 Dalebout et al. .
4,691,916 9/1987 Voris .
4,709,918 12/1987 Grinblat .
4,720,099 1/1988 Carlson .
4,730,828 3/1988 Lane ..... 482/94
4,730,829 3/1988 Carlson .
4,741,529 5/1988 Bloemendaal .
4,768,780 9/1988 Hayes .
4,772,015 9/1988 Carlson et al. ..... 482/908
4,799,671 1/1989 Hoggan et al. .
4,804,179 2/1989 Murphy et al. .
4,807,877 2/1989 Buxton .
4,828,255 5/1989 Lahman .
4,844,450 7/1989 Rodgers, Jr. .
4,844,456 7/1989 Habing et al. .
4,846,458 7/1989 Potts .
4,854,578 8/1989 Fulks .
4,867,445 9/1989 Connelly .
4,872,668 10/1989 McGillis et al. .
4,877,239 10/1989 Dela Rosa ..... 482/907
4,880,230 11/1989 Cook .
4,900,018 2/1990 Ish, III et al. .
4,911,435 3/1990 Johns .
4,949,951 8/1990 Deola ..... 482/138
4,964,632 10/1990 Rockwell .
4,974,837 12/1990 Someya et al. .
5,011,139 4/1991 Towley, III .
5,018,725 5/1991 Cook .
5,026,049 6/1991 Goodman ..... 482/907
5,037,090 8/1991 Fitzpatrick .
5,044,631 9/1991 Jones .
5,044,632 9/1991 Jones .
5,050,872 9/1991 Farenholtz .
5,050,873 9/1991 Jones .
5,058,888 10/1991 Walker et al. .
5,085,430 2/1992 Habing .
5,094,449 3/1992 Stearns .
5,116,297 5/1992 Stonecipher .
5,120,289 6/1992 Yu ..... 482/136
5,135,449 8/1992 Jones .
5,135,453 8/1992 Sollenberger ..... 482/101
5,135,456 8/1992 Jones .
5,171,198 12/1992 Jones .
5,181,896 1/1993 Jones .
5,209,715 5/1993 Walker et al. .
5,250,013 10/1993 Brangi .
5,263,915 11/1993 Habling .
5,273,504 12/1993 Jones .
5,273,505 12/1993 Jones .
5,290,214 3/1994 Chen .
5,302,161 4/1994 Loubert et al. .
5,304,107 4/1994 Jones .
5,314,390 5/1994 Westing et al. .
5,330,405 7/1994 Habing et al. .
5,356,353 10/1994 Takaoka ..... 482/5
5,437,589 8/1995 Habing ..... 482/100
5,486,150 1/1996 Randolph .

OTHER PUBLICATIONS

Peterson, Dr. James A. "Nautilus Sports/Medical Industries, Inc.: Total Conditioning–A Case Study", Brochure, p. 3, Reprinted from Athletic Journal.
Nautilus Sports/Medical Industries, Inc. "Nautilus Powerplus", Brochure.
Hammer Strength, Hammer Strength Picture Price List, Oct. 1994.
Loredan Biochemical, Inc., "Lido Loredan, A New Vision of Strength Training", Brochure, p. 4–5, 17, 1990.
Cybex Div. of Lumex, Inc., "Eagle Fitness Systems by Cybex," Brochure, pp. 10–12.
Cybex Div. of Lumex, Inc. "Eagle Performance Systems, The New Standard of Excellence," Brochure, pp. 2, 3.
Cybex Div. of Lumex, Inc., "Cybex Strength Systems, A Body of Work" (VR), Brochure, 1989/1990.
Cybex Div. of Lumex, Inc., "Cybex Strength Systems", Brochure, pp. II–3, II–5 & VII–27, 1993.
Cybex Div. of Lumex, Inc., "Cybex Strength Systems Owner's Manual", pp. 5 & 6, Brochure.
Cybex Div. of Lumex, Inc., "Cybex Extremity Systems, The Cybex 6000 Extremity System", Brochure, 1991.
Cybex Div. of Lumex, Inc., "Medical Strength Systems", Brochure, pp. 5 & 17, 1993.
Cybex Div. of Lumex, inc., "Cybex Cable Column", Brochure, Jan. 1994.
Cybex Div. of Lumex, Inc., "Cybex Testing and Rehabilitation Systems", Brochure, 1993.
Nautilus Sports/Medical Industries, Inc., "Leverage Machines by Nautilus Instruction manual", Brochure, pp. 12, 14 & 15.
Nautilus Sports/Medical Industries, inc., "Nautilus Instruction Manual", Brochure, pp. 27–33, 1980.
Nautilus Sports/Medical Industries, Inc., "Nautilus Midwest New Products", Brochure.

Atlantic Fitness Products, "Specialists in Physical Fitness and Health Equipment", Brochure, 1985.
Bodymasters, "Expect the Best", Brochure.
Hoist Fitness Systems, "Forged in Steel", Brochure.
Pro–Gym Systems, "Kinesi–Arc by Pro–Gym Systems Plate Loading Line", Brochure.
Muscle Dynamics, "Maxicam by Muscle Dynamics", Product Listing, Brochure.
Paramount, "Single Station Circuit Fitness Line," Brochure.
Universal Gym Equipment, Inc., "Universal Conditioning Machines and Free Weights", Brochure.
Athletic Journal, vol. 59, No. 2, Oct. 1978, Advertisements.

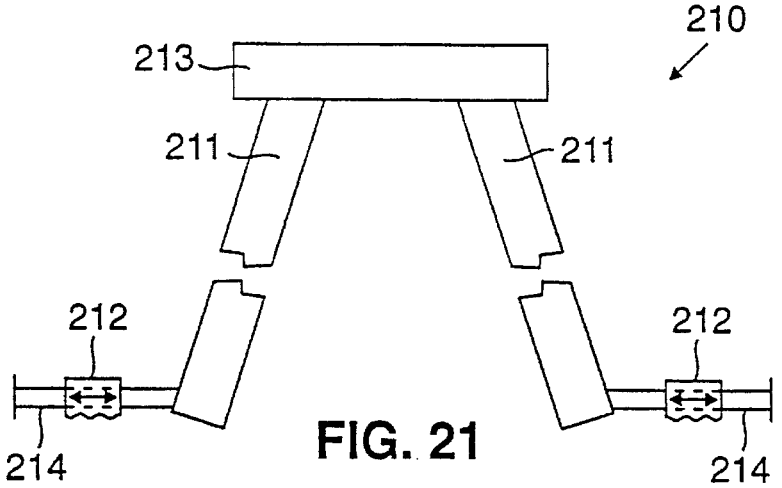
FIG. 21
FIG. 21A
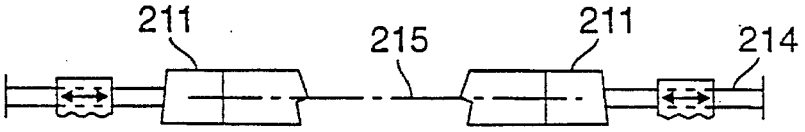
FIG. 21B
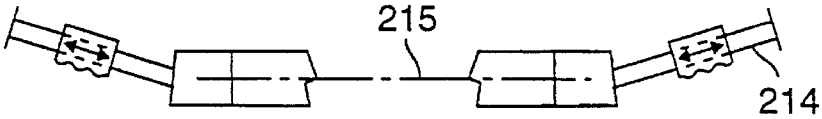
FIG. 21C
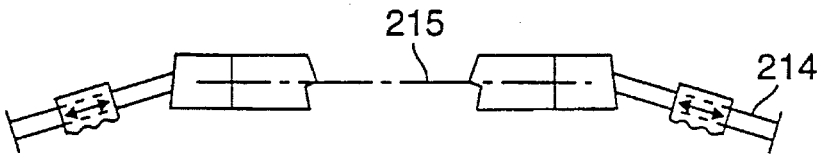
FIG. 21D
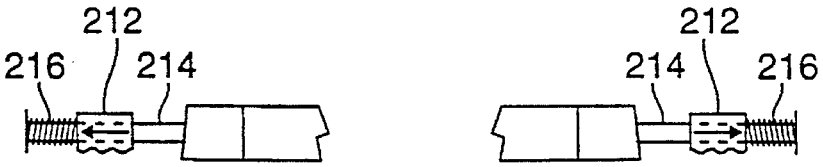
FIG. 21E
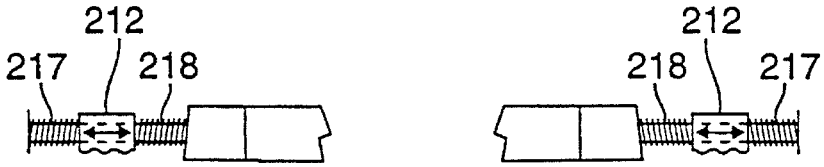
FIG. 21F
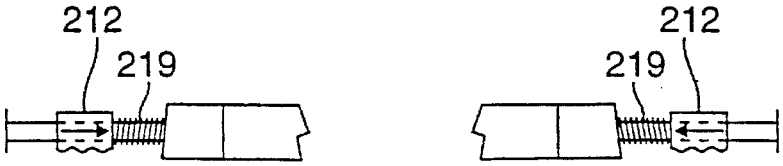

SHOULDER PRESS EXERCISE MACHINE AND METHOD OF EXERCISING

This is a continuation-in-part of pending application Ser. No. 08/396,670, filed Mar. 1, 1995 assigned to the assignee of the present invention, entitled, "Rear Deltoid and Rowing Exercise Machine and Method of Exercising," Roy Simonson, inventor.

FIELD OF THE INVENTION

The invention relates to the field of exercise and physical rehabilitation equipment; in particular, to an apparatus and method for exercising the upper torso.

BACKGROUND OF THE INVENTION

It is often necessary or desirable for a person to exercise a particular muscle or group of muscles. For example, when a muscle is damaged, such as through injury or surgery, it is important to exercise the muscle to prevent atrophy and to strengthen the muscle for normal use. Further, people exercise healthy muscles to increase strength and to maintain an active and healthy lifestyle, as well as to improve their appearance. Various routines have been developed to exercise different muscle groups by forcing the muscles to contract and extend under a load, such as by moving a free weight against the force of gravity or by moving a handle whose movement is resisted by an exercise machine.

One such exercise is known as a shoulder press. An exerciser sits upright on a seat and grasps a barbell at shoulder level. The exerciser then pushes the barbell upward, extending his arms, and lowers it down. This exercise can be dangerous as the exerciser may drop the barbell. Further, the exerciser should have a partner to spot him in case he fails to lift the weight. When using free weights, the resistance provided by gravity is constant while the strength of the muscles varies over the range of motion. Consequently, the muscles are not fully loaded at each point over the range.

During a shoulder press, the hands seek to follow a curved path inward as the weight is extended upward. This path cannot be followed when using a barbell because the hands are maintained at a fixed distance. Further, the user's head must be tilted back or forward during the lower portion of the stroke to clear the barbell. These deficiencies can be overcome by performing the exercise with dumbbells.

To overcome these difficulties, machines have been developed that simulate the exercise movements of a shoulder press. In one apparatus marketed by the assignee of the instant application, a user exercises by pushing handles upward from shoulder height while in a sitting position. A seat and backrest are mounted to a frame to position a user. Two arms are connected together and rotatably mounted to the frame. The handles are mounted to the arms. The pivot for the arms is disposed behind the seat at about shoulder level. A cable operably connects the arms to a weight stack such that when a user pushes on the handles, thereby rotating the arms, the weight stack is lifted and provides resistance to the exercise. The cable may extend over a variable radius cam which alters the distance the weight is displaced for a given amount of handle rotation. In this configuration, the resistance to the movement of the handles can be varied to match the strength curve of the back and shoulder muscles. While this apparatus has solved many problems associated with performing a shoulder press exercise with barbells or dumbbells, it does not permit the user to vary the distance between his hands while performing the exercise.

In another apparatus, disclosed in U.S. Pat. No. 5,044,632, an exercise machine is disclosed in which levers are rotatably mounted to a frame above the seated user. Handles are mounted to the levers. Resistance to handle movement is provided by weight plates mounted to the levers. The hinges for the levers are disposed at an angle of 5° with respect to a central vertical midplane, such that the user must move his hands in defined arcs in diverging planes as he presses upward on the handles. This apparatus forces the user's hands to follow a preset rate of convergence and divergence during the exercise stroke, regardless of the user's anatomy. This apparatus does not permit the user to select his own path of motion for the press exercise. Rather, the motion is dictated by the angle of the hinges.

A shoulder exercise apparatus is disclosed in U.S. Pat. No. 4,603,856. In this device, a bench is provided for the user to exercise in a prone or supine position. A shaft extends from a ball and socket joint mounted to the side of the bench, and a handle is slidably mounted to the shaft. Frictional resistance is provided both at the ball and socket joint and at the sliding connection between the handle and the shaft. The user exercises by moving the handle against one or both of these resistances. While providing multiple paths of motion through the range of the ball and socket joint, this machine provides for exercising only one arm at a time, cannot coordinate the motion of two arms, and has the disadvantages associated with frictional resistance such as changing resistance due to heat buildup, and wear. Further, this machine only provides concentric action (i.e., where the muscles contract against a load). No eccentric action (i.e., where muscles extend under a load) is possible with this machine.

SUMMARY OF THE INVENTION

It is therefore an object of this invention to provide an apparatus and method for performing a shoulder press exercise in which the user can vary the distance between his hands while performing the exercise.

It is another object of the present invention to provide an apparatus and method for performing a shoulder press exercise in which a user can select the path of hand motion best suited for his particular anatomy.

It is another object of the present invention to provide an apparatus and method for performing a shoulder press exercise in which a resistance is provided against the lateral movement of a user's hands.

It is another object of the invention to provide an apparatus and method for performing a shoulder press exercise that permits the use of a few heavy weight plates along with a fine tuning mechanism to provide resistance to the exercise.

It is another object of the invention to provide an apparatus and method for performing a shoulder press exercise in which a self-aligning pulley is provided to compensate for misalignment.

These and other objects of the invention will be clear from the following description of the invention.

In accord with one aspect of the invention, an apparatus is provided for exercising the muscles of a user. A primary hinge is mounted to a frame. A secondary hinge is mounted to the primary hinge. An arm is mounted to the secondary hinge. A handle is mounted to the arm distal to the secondary hinge. The handle is adapted to be grasped and displaced by the user. Due to the orientation of the two hinges, the handle may be displaced in both a longitudinal direction and a lateral direction, as selected by the user. A means for resisting the displacement of the handle, preferably in both the lateral and longitudinal directions, is provided. The resistance means may include a weight stack operably engaged to the primary hinge. A second handle, arm and secondary hinge may be provided for the other hand so that the user may exercise both halves of his body. The arms may be connected such that both handles move the same longitudinal and/or lateral distance.

In accord with another aspect of the invention, a method is provided for exercising with an apparatus having an arm pivotally mounted to a frame. A user selects a weight for exercise and sits on a user support. The user grasps a handle mounted to the arm and pushes the handle upward from the level of his shoulders, moving the handle longitudinally and laterally as he so chooses. The user overcomes resistance to the lateral movement of the handle and resistance to the longitudinal movement of the handle. The user may grasp a second handle with his other hand to exercise both halves of his body. The handles may be connected such that both handles move the same longitudinal and/or lateral distance.

BRIEF DESCRIPTION OF THE DRAWINGS

FIG. 21 is a partial schematic view of the hinge mechanism, arms and handles of an embodiment of the invention having outward sliding hand grips;

FIG. 21A is a partial schematic end view of the arms and handles of FIG. 21;

FIG. 21B is a partial schematic end view of the arms and handles of an embodiment of the invention having angled handle rods;

FIG. 21C is a partial schematic end view of the arms and handles of an embodiment of the invention having angled handle rods;

FIG. 21D is a partial schematic end view of the arms and handles of an embodiment of the invention having a handle rod resistance mechanism;

FIG. 21E is a partial schematic end view of the arms and handles of an embodiment of the invention having a handle rod resistance mechanism;

FIG. 21F is a partial schematic end view of the arms and handles of an embodiment of the invention having a handle rod resistance mechanism;

DETAILED DESCRIPTION

Figure 1:
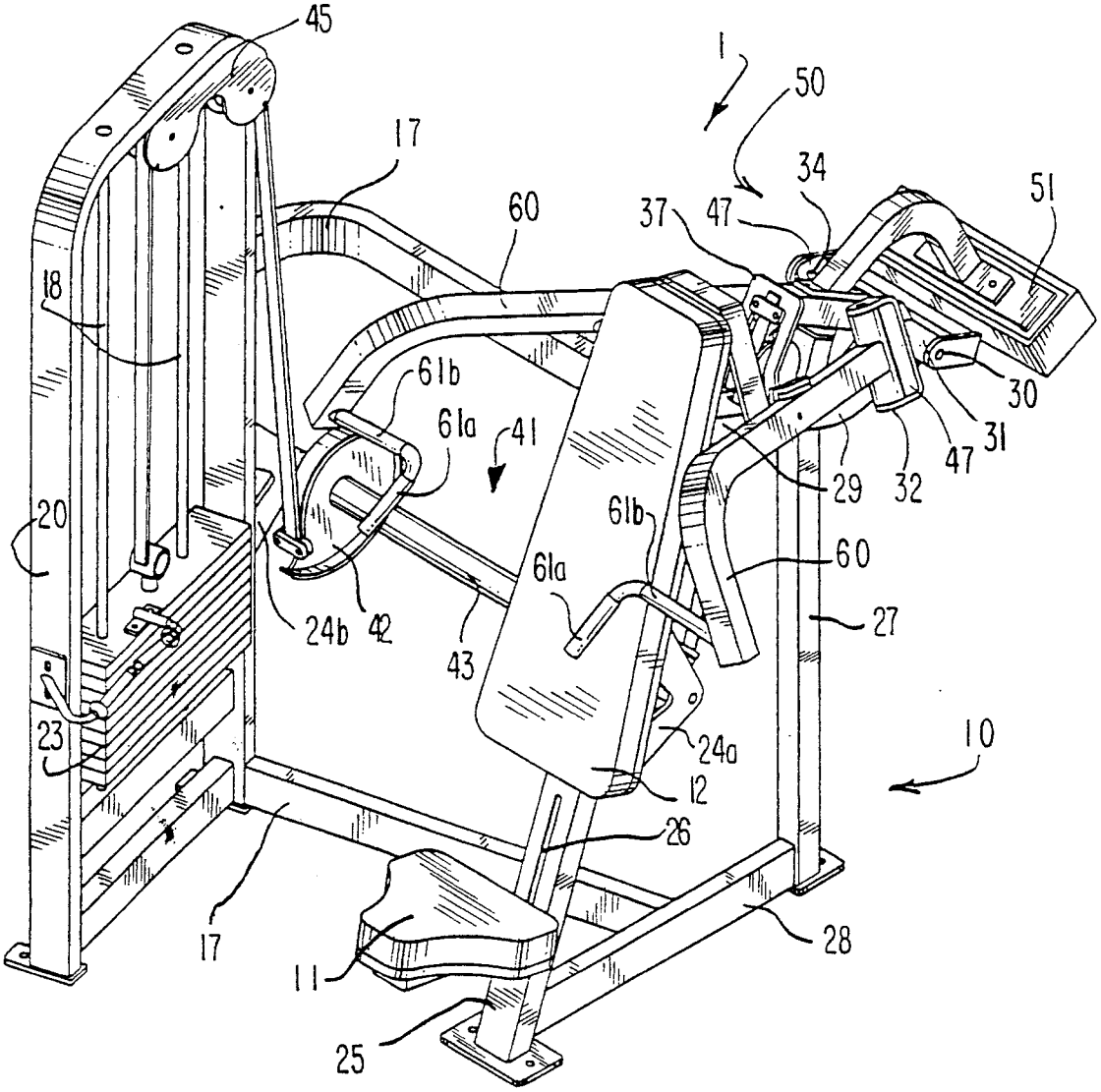
FIG. 1 is a perspective view of an embodiment of a shoulder press exercise machine of the present invention, with the handles in a rest position.

FIG. 1 is a perspective view of an embodiment of the shoulder press machine 1 of this invention in the rest position. Unless otherwise noted, the structural components of the machine are a mild steel. The exercise machine has a frame 10 comprising a front leg 25, a rear brace 27, a gusset 28, and a hinge brace 29 (see FIG. 5). In the preferred embodiment, the frame is constructed of 1½×3 inch, 11 gauge rectangular steel tubing. A seat 11 is mounted to the front leg 25 of the frame. The seat is adapted to be positioned at various heights along a slot 26 in the leg to provide a comfortable starting position and to allow a full range of motion for users of varying stature. A backrest 12 is mounted on the leg above the seat. Preferably, the leg 25 is angled away back such that the backrest 12 is in a partially reclined position. The seat may be disposed perpendicular to the backrest. The seat and backrest comprise a user support adapted to maintain the user in a comfortable position for exercising. As discussed more fully below, the user exercises by pushing handles 61 upward from a rest position. The handles are operably engaged, in a manner described below, to weight plates 23 such that the weight plates must be lifted to displace the handles upwards and inwards.

As shown in FIG. 1, the arms 60 are mounted to the frame 10 by a hinge mechanism 50, including a primary hinge 30 and secondary hinges 32 and 34. The primary hinge 30 is mounted to the frame 10 and is located behind the top of the seat 11. In a preferred embodiment, the hinge brace 29 of the frame curves upward in the rear for mounting the primary hinge 30 (see FIG. 5). The primary hinge is disposed perpendicular to a vertical plane X—X (see FIG. 2) extending through the center of the machine 1. While in the currently preferred embodiment the primary hinge 30 is disposed directly behind the top of the backrest 12, it could be located in other positions and still practice the invention. In particular, the primary hinge could be raised or lowered from this position to vary the potential paths of handle motion during the shoulder press exercise.

Figure 2:
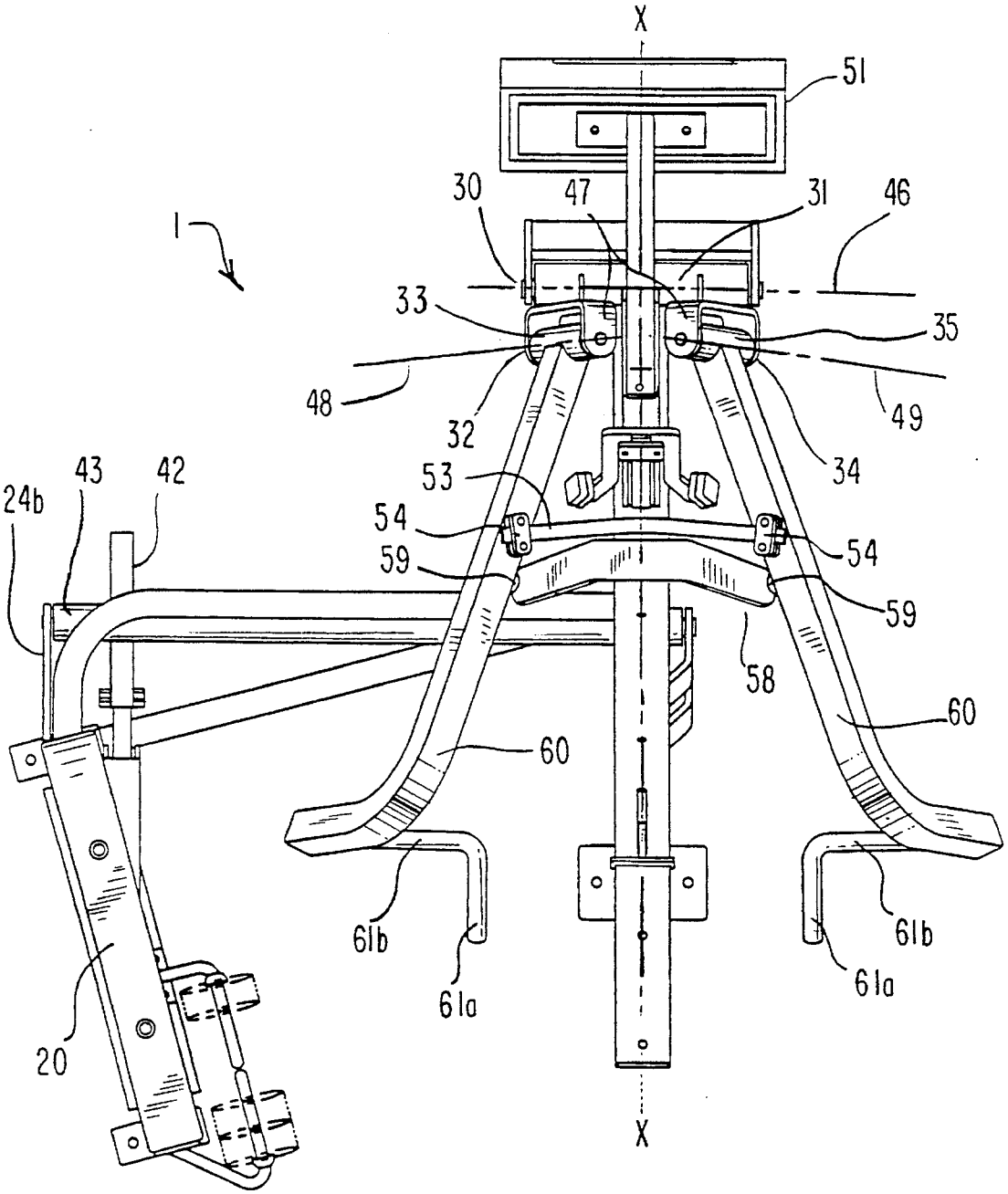
FIG. 2 is plan view of the exercise machine of FIG. 1 with the seat and backrest removed.

FIG. 2 is a top view of the apparatus of FIG. 1 with the arms 60 in the rest position, contacting the arm rest bracket 58 with arm bumpers 59. The seat and backrest have been removed for clarity. The primary hinge 30, as currently preferred, includes a primary bearing tube 31 mounted on sealed bearings (not shown), such as model #87503 metric bearings manufactured by Fafnir, or an equivalent. The primary bearing tube 31 is rotatable about a primary axis 46 which axis is disposed perpendicular to the vertical plane X—X extending through the center of the machine.

Figure 3:
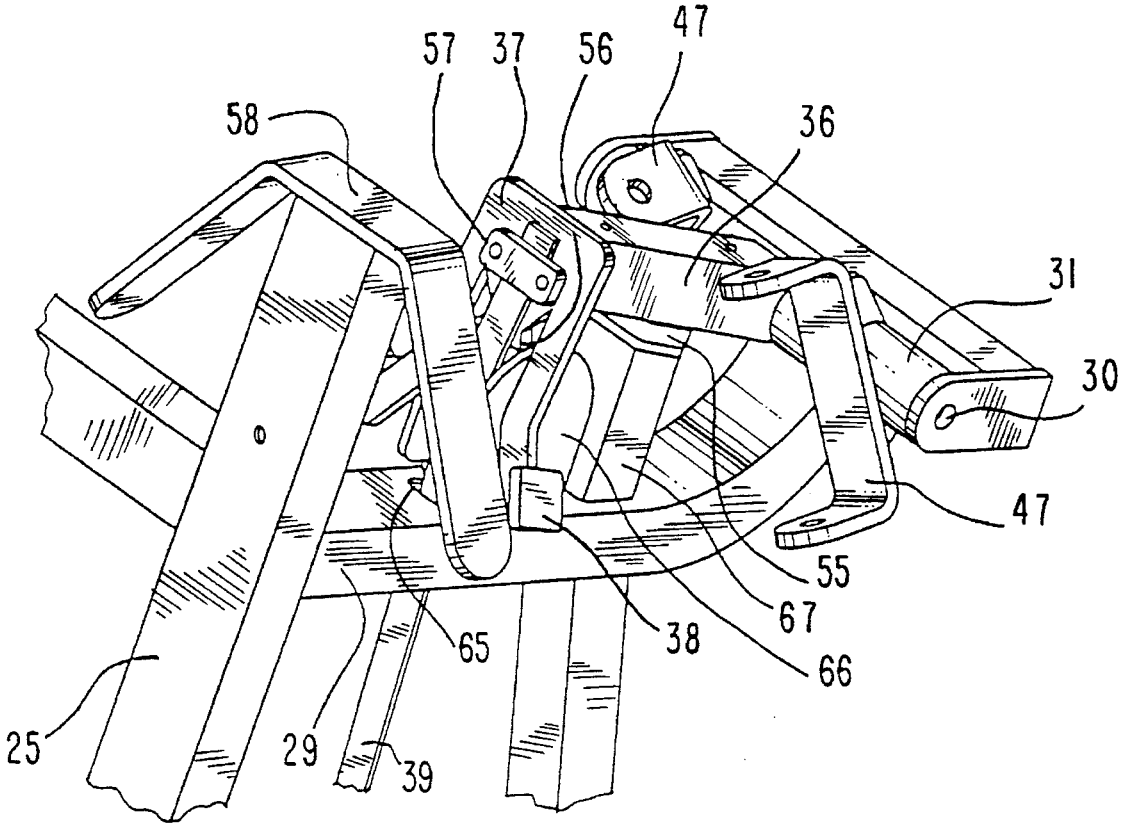
FIG. 3 is a partial perspective view of the hinge portion of the exercise machine of FIG. 1, with the counterweight, arms and secondary hinges removed.

Brackets 47 are rigidly mounted to the primary bearing tube 31, such as by welding (see also FIG. 3). The secondary hinges 32 and 34 are rotatably mounted to the brackets. The secondary hinges include the secondary bearing tubes 33 and 35 mounted to sealed bearings (not shown), such as model #87503 metric bearings manufactured by Fafnir, or an equivalent. The secondary bearing tubes are rotatable about secondary axes 48 and 49. The secondary hinge axes 48 and 49 are skew to the primary hinge axis 46; in other words, the secondary hinge axes are not parallel to the primary hinge axis.

Figure 1A:
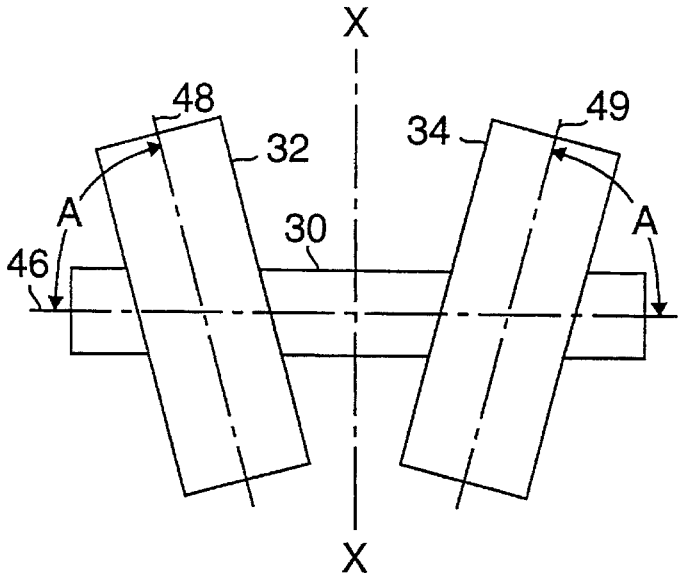
FIG. 1A is a schematic view of a hinge mechanism for use in the exercise machine of FIG. 1, in a plane IA—IA shown in FIG. 5.
Figure 1B:
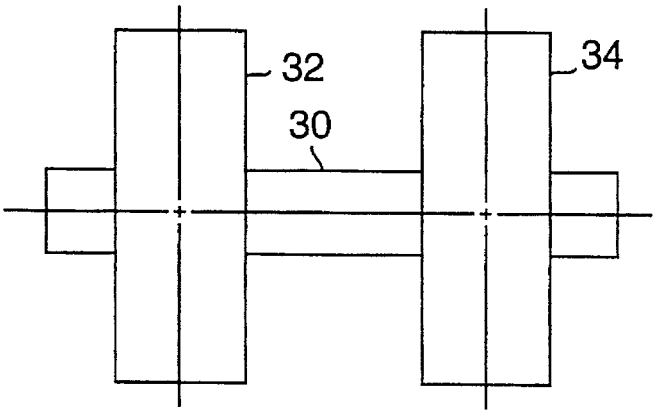
FIG. 1B is a schematic view of a hinge mechanism for use in the exercise machine of FIG. 1, in a plane IA—IA shown in FIG. 5.
Figure 1C:
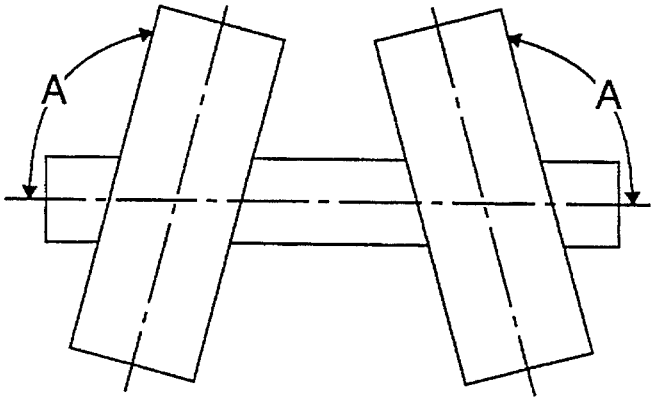
FIG. 1C is a schematic view of a hinge mechanism for use in the exercise machine of FIG. 1, in a plane IA—IA shown in FIG. 5.

The arms 60 are rigidly attached to the secondary bearing tubes 33 and 35. In the preferred embodiment, the arms curve approximately 90° downward at a point distal the secondary bearing tubes to become essentially parallel to the secondary hinge axes. In the rest position (i.e., when no weight is being lifted), the proximal portions of the arms 60 are oriented at about 16° from horizontal as viewed from the side (see FIG. 5); the proximal portions of the arms are oriented about 19° from the vertical plane X—X extending through the center of the machine when viewed from above (see FIG. 2); and the proximal portions of the arms are oriented at about 50° from the central vertical plane X—X when viewed from the front. While this arm orientation is preferred, other angles and relationships could be used and still practice the invention. As discussed more fully below, the angular relationship of the primary hinge 30 to the secondary hinges 32 and 34 effects the resistance to handle movement. As currently preferred, that angular relationship is fixed. Referring to FIGS. 1A, 1B and 1C, which are schematic views of the primary hinge and secondary hinges in plane IA—IA (see FIG. 5), the secondary hinges are disposed at an angle A with respect to the primary hinge. The preferred angle A is 120°, as shown in FIG. 1C and explained below.

The hinge mechanism 50 operates to divide the resistance provided by the weight stack 23 (see FIG. 1) into a longitudinal component and a lateral component. These separated components of resistance increase the effectiveness of the exercise and provide feedback to the user that encourages symmetrical exercise paths of the right and left hands.

The secondary hinge angle A (see FIGS. 1A, 1B and 1C) establishes the relationship of the lateral component to the longitudinal component. When the secondary hinge angle is 90°, as shown in FIG. 1B, there is no lateral component. Rather, all the resistance is attributed to the longitudinal component. Consequently, the user can move the handles 61 laterally without lifting the weight stack 23 at all. Furthermore, the user can move one hand in the lateral direction without moving the other, and perceive no difference between the resistance applied to the left and right arms. Raising the handles longitudinally, however, lifts the weight stack. Such a system may be desirable to allow the user to select independent, comfortable hand positions while performing a traditional (i.e., longitudinal resistance only) shoulder press exercise.

As the secondary hinge angle A is increased or decreased from 90° (as shown in FIGS. 1A and 1C), a component of the weight stack resistance becomes attributable to the lateral component. In other words, lateral handle movement causes the weight stack to lift. As the secondary hinge angle A diverges more from 90°, the weight stack is lifted further for the same lateral handle movement If the angle A is reduced below 90° as shown in FIG. 1A, the arms resist an outward movement of the handles; if the angle A is increased above 90°, as shown in FIG. 1C, the arms resist inward movement.

With a secondary hinge angle A other than 90°, asymmetry between the position of the user's right and left hands during an exercise stroke will cause the user to feel asymmetric feedback from the machine. The typical user will naturally seek to distribute the load equivalently between the left and right sides. Consequently, the secondary hinge angle of more or less than 90° encourages the user to move his hands symmetrically. The more the secondary hinge angle A diverges from 90°, the more the user is encouraged to perform the exercise symmetrically.

By providing lateral resistance, and by encouraging a symmetric stroke, the hinge mechanism 50 can make the exercise machine feel "stable" as perceived by a user. It has been found that in using a machine with a hinge angle A of 90°, the user perceives that the exercise stroke is unstable because lateral hand movement is unresisted. This sensation is more pronounced in exercises requiring pushing, such as the shoulder press exercise of the present exercise machine, than in pulling exercises. A machine with a hinge angle A other than 90° feels more stable to a user because it resists lateral movement and encourages a symmetrical stroke. The perception of stability increases as angle A diverges from 90°.

The preferred secondary hinge angle of 120° (as shown in FIG. 1C) has been found by experimentation to produce the most comfortable or natural shoulder press exercise stroke. In particular, the relationship of lateral resistance to longitudinal resistance at this angle seems to provide an effective exercise for the muscles of the shoulders. Further, sufficient lateral resistance is provided so that a user perceives the shoulder press exercise as stable. Other secondary hinge angles could be selected for a machine based on the comfort, stability, muscular development or exercise goals of a particular group of users to emphasize the longitudinal or lateral resistance to the exercise.

Referring again to FIG. 1, a weight stack brace 20 is attached to the frame 10 by beams 17 in a position easily accessed by a user seated in seat 11. Chevron-shaped bridges 24*a* and 24*b* (see also FIG. 5) are rigidly mounted to front leg 25 and the weight stack brace 20, respectively. The chevron-shaped bridges support a transmission 41, including a rod 43, an eccentric cam 42 and a pulley 44 (see also FIG. 5). A weight stack pulley set 45 is mounted to the top of the weight stack brace 20, with pulley 45*a* aligned with the cam 42 and pulley 45*b* aligned with the weight stack 23 (see also FIG. 6). Rails 18 are mounted vertically within the weight stack brace 20. Weight stack 23 is slidingly mounted to the rails 18 and provides a resistance to the exercise. Springs 19 (see FIG. 6) may by positioned on the rails to absorb the shock of the weight plates as they are lowered onto the brace. Of course, other mechanisms for providing resistance, such as a friction, springs, elastic bands, pneumatic or electromagnetic resistance, or an air resistance fan could be employed (either alone or in combination) and still practice the invention. Additionally, free weights could be operably engaged to the arms 60 to resist the movement of handles 61.

FIG. 3 is a partial perspective view of the hinge mechanism and surrounding elements of the machine of FIG. 1 in the rest position, with the backrest, counterweight, arms and secondary hinges removed. A lever 36 is rigidly mounted to the primary bearing tube 31, such as by welding. In the preferred embodiment, the lever 36 extends from the primary bearing tube toward the front of the machine and is inclined upward.

In the rest position shown in FIG. 3, the lever 36 rests on a rubber or elastomer stop 55. The stop is mounted on a stop support 67, which, in turn, is mounted to the hinge brace 29. The stop and stop support limit the downward rotation of the lever 36, defining the rest position.

An arm rest bracket 58 is mounted to the top of the front leg 25. The arm rest bracket maintains the handles 61 at a comfortable starting width in the rest position, while providing sufficient space between the handles for the user to access the seat. The bracket 58 is angled outward and downward from the top of the front leg 25 so the arms are guided to the rest position as they are lowered. Arm bumpers 59 (see FIG. 4) are provided to prevent the arm rest bracket from scratching the arms.

Figure 4:
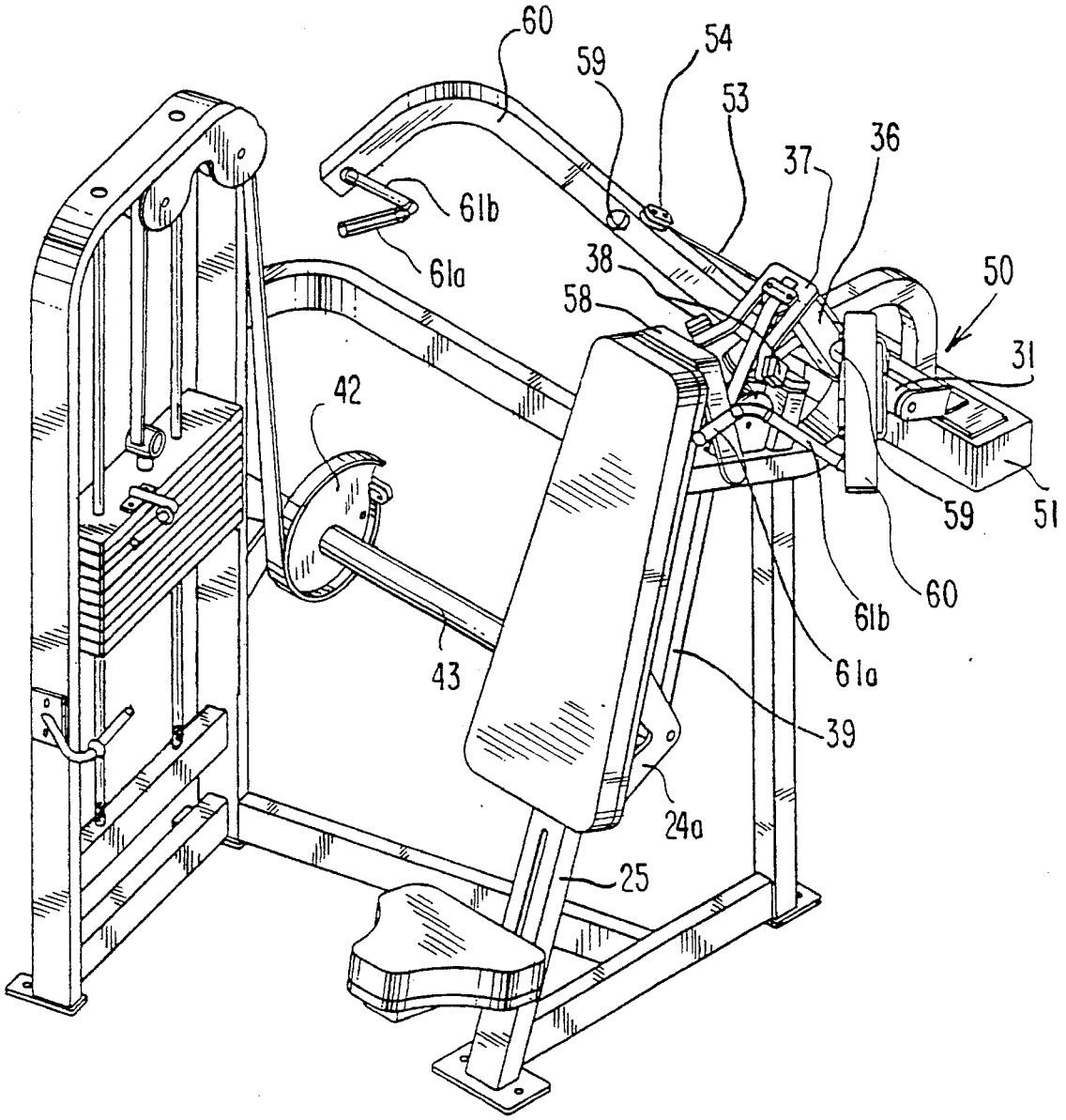
FIG. 4 is a perspective view of the exercise machine of FIG. 1, with the handles pressed upward.

FIG. 4 is a perspective view of the apparatus of FIG. 1 showing the arms 60 pushed upward in the longitudinal direction (i.e., not in the rest position). Handles 61 are mounted at the end of the arms 60 distal to the hinge mechanism 50. The handles 61*a* present the user with a neutral grip; handles 61*b* present the user with a barbell grip. Alternatively, a variable position handle such as a pivoting handle, or a pad for pushing with the user's arm, wrist or elbow, could be attached to the arm to permit the user to perform other exercises.

A bumper bracket 37 is mounted to the lever 36 distal to the primary bearing tube (see also FIG. 3). The bumper bracket 37 has bumpers 38 positioned to contact the arms 60. The bumper bracket 37 and bumpers 38 serve to limit the inward travel of the arms 60 when the machine is not in the rest position, as during an exercise stroke.

An arm strap 53 connects the arms 60 to limit outward travel of the arms during the exercise stroke and in the rest position. The arm strap is preferably KEVLAR® fabric, although other high-strength tethers could be used. Preferably, the belt is held on the arms by a pressure plate 54 that clamps the strap to the arms (see also FIG. 2). The strap is positioned on the arms 60 so that it remains distal the end of the lever 36 during any arm movement. During an exercise stroke, outward movement of the arms is thus limited by the strap 53, while inward movement of the arms is limited by the bumpers 38. Alternatively, mechanical stops attached to the primary bearing tube or other components could be used to limit outward arm travel and still practice the invention.

Figure 5:
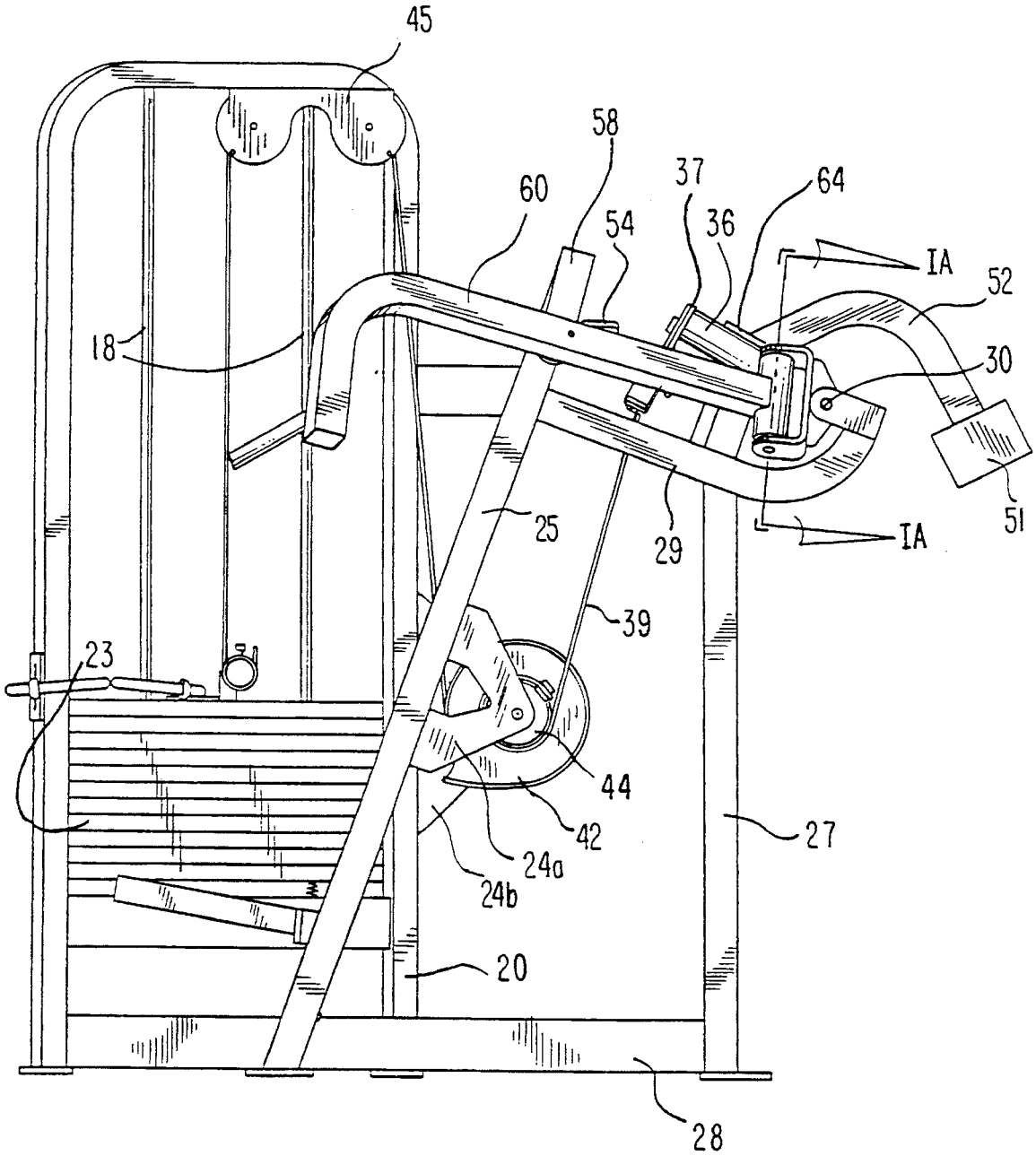
FIG. 5 is a side elevation view of the exercise machine of FIG. 1 with the seat and backrest removed, in the rest position.

FIG. 5 is a side elevation view of the apparatus of FIG. 1 in the rest position. The front leg 25 is disposed at about 70° from horizontal. The pitch of the leg could be altered to cause the user to recline more or to sit up straighter, thereby changing the effect of the exercise. In the rest position shown in FIG. 5, the arms are in contact with the arm rest bracket 58.

A counterweight 51 is provided to counteract the moment about the primary hinge 30 caused by the weight of the arms 60. The counterweight is rigidly attached to a counterweight bracket 52, which is mounted to the lever 36, as by bolting through an integral flange 64. The bracket 52 suspends the counterweight 51 behind the primary hinge 30. Because the weight of the arms 60 is removed from the total resistance encountered during an exercise stroke, the increments of the weight stack 23 proportionately reflect the weight lifted by the user.

Figure 6:
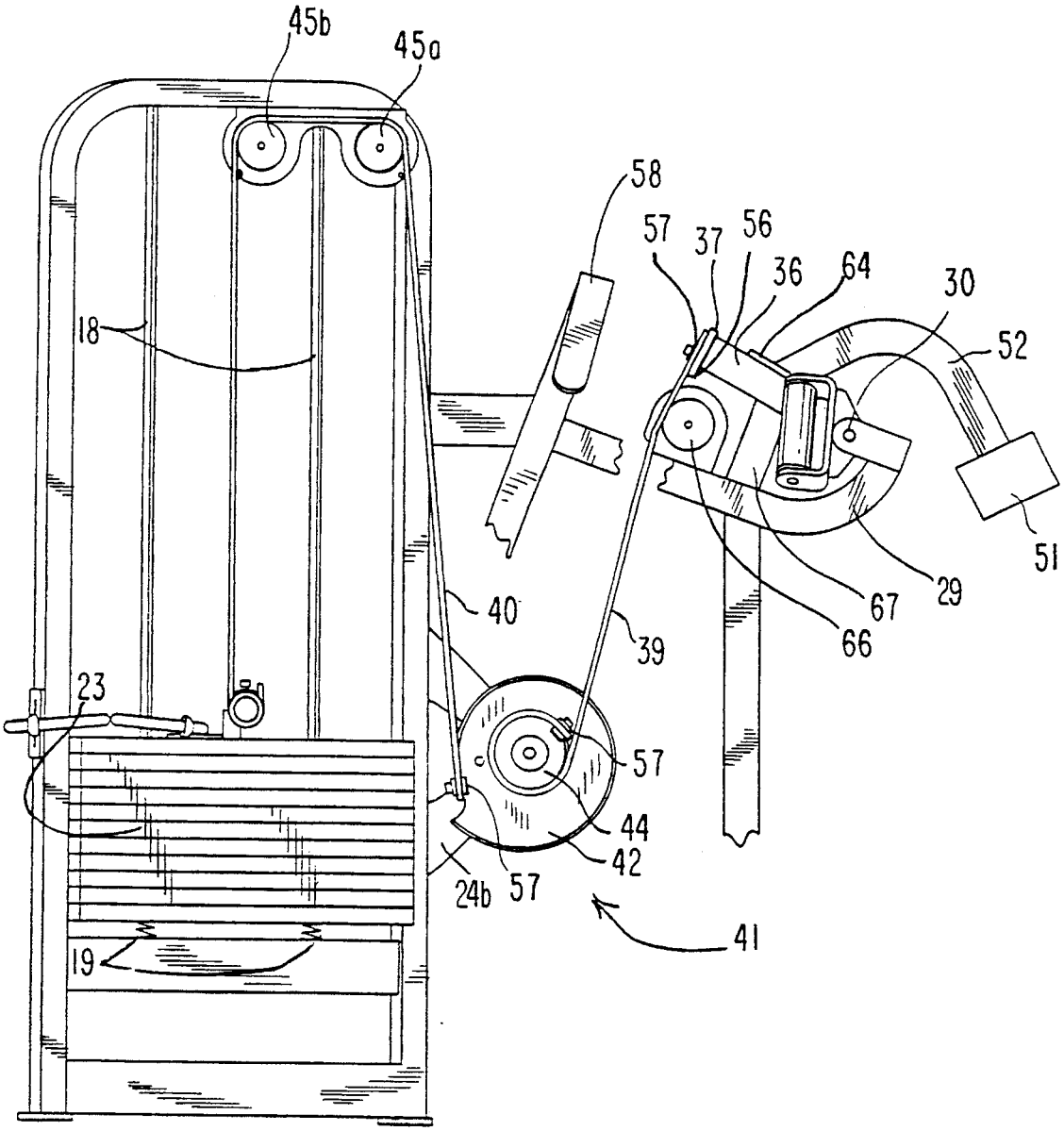
FIG. 6 is a partial side elevation view of the exercise machine of FIG. 1 with the arms and other components removed, showing the power transmission system.

FIG. 6 is a cut-away view of exercise machine of FIG. 1 showing the transmission 41. Lever 36 is rigidly attached to and rotates with the primary hinge 30. A first belt 39 is attached over the bumper bracket 37 (partially cut away for clarity in FIG. 6) at the distal end of the lever. The first belt is preferably KEVLAR® fabric. Other high-strength tethers could be used, however, and still practice the invention, including other high strength fabrics, cables, chains and ropes. Preferably, the belt is held on the bumper bracket by a pressure plate 57 that clamps the belt to the bumper bracket. Such a plate typically would be attached to the bumper bracket by bolts, as is known in the art. Integral with the bumper bracket 37 is a curved tip 56 for preventing the belt from bending over a corner or sharp edge of the lever (see also FIG. 3). The first belt 39 passes over a frame pulley 66 mounted on the hinge brace 29, passes through an opening 65 provided in the hinge brace (see FIG. 3) and is attached to the pulley 44 of the transmission 41 using another pressure plate 57 and appropriate attachment means, such as bolts. In the rest position, the belt is wound about the circumference of the pulley 44.

A second belt 40 is attached at one end to the cam 42, again by a pressure plate 57. The second belt is also preferably KEVLAR® fabric or another high strength tether. The belt 40 then extends over the weight stack pulleys 45*a* and 45*b* and is attached to the weight stack 23. As the user presses upward or inward on the handles 61 (see FIG. 1), the lever 36 rotates, causing the first belt 39 to unwind and rotate the pulley 44. As the pulley rotates, the rod 43 and the cam 42 rotate as well. The rotation of the cam pulls the second belt 40 over the weight stack pulleys 45, and thus lifts the weight stack 23. The eccentric shape of the cam 42 changes the effective resistance of the weight stack over the range of motion. The tension of the belt 39 pulling the lever 36 is directly proportional to the radius of the cam 42 at the point of tangency of belt 40. The cam profile is selected in a manner well-known in the art to match the force profile of an exercise stroke with the strength curve of the shoulder and arm muscles of a typical user.

Figure 7:
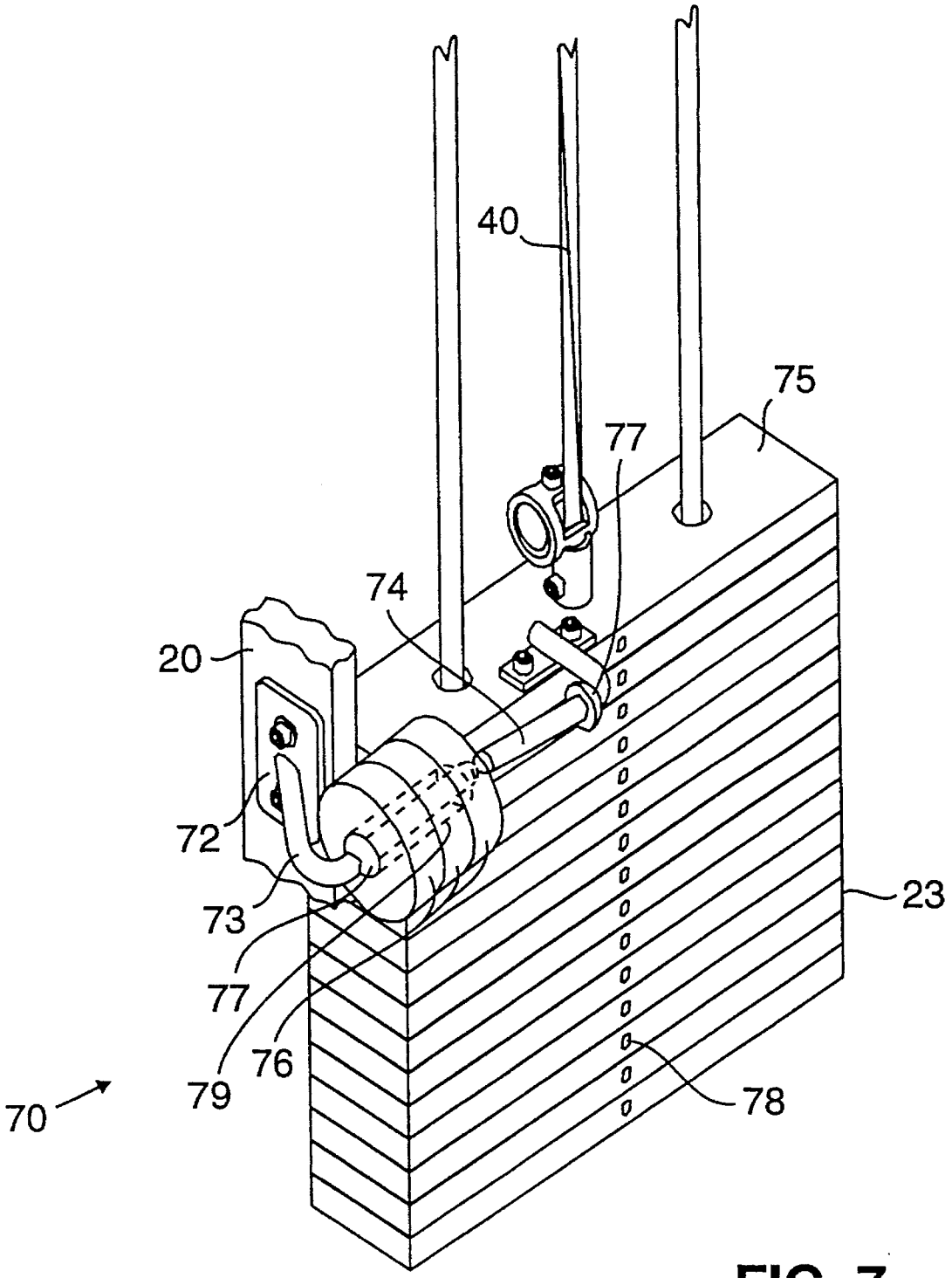
FIG. 7 is a perspective view of an incremental weight stack for use with an exercise machine, including the exercise machine of FIG. 1.

FIG. 7 is a perspective view of an incremental weight stack 70 for use with a selectorized exercise machine, such as the apparatus of FIG. 1. A flange or storage finger 73 (shown partly in phantom) is rigidly mounted to a flange 72, which in turn is attached to the weight stack brace 20 (see also FIG. 1) such as by bolting. Slotted holes (not shown) may be provided in the flange 72 for height adjustment. The flange finger extends proximate to the top weight plate 75. A stack or movement finger 74 is mounted to the top of the top weight plate 75. Incremental weights 76, having tracks such as axial bore 79 (shown in phantom) for receiving the fingers 73 and 74, are slidingly mounted on the flange finger 73. When the weight stack is lowered (i.e., in the rest position), the tips of the frame finger 73 and the stack finger 74 are adjacent, almost touching. The incremental weights can be moved from the flange finger to the stack finger as desired. The tips of the fingers 73 and 74 may be rounded to provide for a smooth transfer of the incremental weights 76. Rubber or elastomer bumpers 77 can be mounted to the fingers to restrict the movement of the incremental weights on the fingers. Preferably, both fingers are slanted up toward the tips at approximately 5° from horizontal. This angle retains the incremental weights on the respective fingers while permitting the weights to easily slide from one finger to the other. When the user lifts the weight stack, he also must lift any incremental weights on the stack finger.

The incremental weight stack 70 permits use of heavy plates on the main weight stack 23. For example, each plate on the main stack may weigh 20 pounds. Each incremental weight may be 5 pounds. If three incremental weights are mounted to the flange finger, the user can select the appropriate resistance in five-pound increments by sliding the appropriate number of weights to the stack finger. This allows the user to finely adjust the resistance at any point throughout the weight stack. Further, the manufacturer will save costs in manufacturing and assembling an exercise machine with the incremental weight stack due to the labor saved using a smaller number of plates.

To operate the apparatus of the present invention, a weight is selected on the main weight stack by placing a pin (not shown) in one of the holes 78, as is known in the art. A weight 76 from the incremental weight stack is selected, if desired, and moved onto the stack finger 74 (see FIG. 7). The user adjusts the seat 11 to a suitable position on the leg 25 (FIG. 1). For example, a user with a longer torso will adjust the seat to a lower height such that the handles 61 are positioned at a comfortable starting height for the shoulder press exercise. The user then grasps the handles, either in the neutral or barbell grip, and pushes upward. The movement of the handles causes the arms 60 to move which, in turn, cause the secondary bearing tubes 33 and 35 and the brackets 47 to move. The movement of the brackets cause the primary bearing tube 31 to rotate which, in turn, causes the lever 36 to rotate. As the lever rotates, it pulls the first belt 39, causing the pulley 44 to rotate. As the pulley rotates, the rod 43 and cam 42 rotate, pulling on the second belt 40 and lifting the selected weight. The user then returns the handles to the initial position, thereby lowering the weight. When the user pushes the handles upward (concentric action), he overcomes the resistance provided by the weight. When the user returns the handles (eccentric action), he succumbs to the resistance provided by the weight.

A user may choose to emulate a traditional shoulder press exercise by grasping the barbell grip handles 61*b* in the rest position (a wide hand width) and pressing directly upward while maintaining his hands at a constant width. In this exercise, the arm strap 53 between the arms 60 remains taut, and there is no lateral movement of the handles. As a result, the secondary bearing tubes 33 and 35 are not caused to rotate with respect to the brackets 47. Rather, only the primary bearing tube 31 rotates and the apparatus operates in a manner similar to traditional machines.

Alternatively, the user may choose a shoulder exercise with an inward lateral component of motion. In this exercise, the user begins the exercise stroke by grasping either the neutral handles 61*a* or the barbell handles 61*b* at the rest position and follows a "C" shape, pressing upward at the beginning of the stroke and bringing the handles together in an arcuate path at the end of the stroke. The user encounters resistance in both the longitudinal and lateral components of the concentric portion (i.e., where the muscles contract against the load) of the stroke. In a traditional machine, this would not be possible. In the apparatus of the present invention, however, the hinge mechanism 50 allows such movement. The handle 61, and thus the arm 60, can be moved in a plane perpendicular to the corresponding secondary axis 48 or 49 (see FIG. 2) without encountering resistance from the weight stack because such movement requires only that the secondary bearing tubes 33 and 35 rotate. The primary bearing tube, and thus the lever, need not rotate. However, as the handles are moved in toward the center of the machine in any other plane, the secondary hinges 32 and 34 must revolve about the primary axis 46. This causes the primary bearing tube 31 to rotate. In effect, the primary bearing tube must rotate to compensate for the lateral movement of the handle. This causes the lever 36 to rotate and displace the weight stack, as described above. Thus the weight stack resists movement of the handles both upward and inward.

Advantageously, the user cannot "lock out" his elbows at the end of the exercise stroke to transfer the load from the muscular system to the skeletal system, as is possible on traditional machines and free weights. In the exercise machine of the invention, the lateral component of the resistance continues to oppose the shoulder muscles even when the user's elbows are straightened.

The hinge mechanism 50 permits movement of the handles 61 upward (i.e., longitudinally) and inward (i.e., laterally) in a relationship selected by the user. Consequently, the user can grasp either set of handles and push upward and inward in the natural arcuate path. Alternatively, the user can select another path to give the muscles a different workout. For example, the user may wish to push directly upward and then move directly back, emulating the purely longitudinal motion of a traditional shoulder press. The user may instead choose to press his hands directly upward, and then, at the end of the stroke, move his hands in latitudinally while his arms are fully extended. The user may choose to move his hands out latitudinally near the beginning of the stroke, and then push upward longitudinally. The user can even chose a "figure eight" path, moving his hands in, out, in and out again during the exercise stroke. Any combination of such movements can be accomplished with the machine of the present invention.

The user has flexibility in how he exercises the muscles of his shoulders. The resistance overcome by the particular muscle group is determined, in part, by the selected path of the hands and the secondary hinge angle A. The secondary hinge angle A is selected to present a combination of lateral resistance and longitudinal resistance that feels comfortable or natural to a typical user moving his hands in an arcuate path. Consequently, the user defines, in part, the resistance profile by his path selection. The double hinge mechanism 50 thus provides a fundamental advance over existing exercise machines by establishing a predetermined ratio of lateral to longitudinal resistance while encouraging left-to-right hand symmetry in the exercise stroke and allowing the user to select the path of the stroke and the muscle group emphasized.

Since the secondary bearing tubes 33, 35 are both mounted to the primary bearing tube 31 at symmetrical orientations, the hinge mechanism 50 encourages symmetrical movement of the handles 61. Such symmetrical movement, however, is not required. The user can move his hands through different paths during the same exercise stroke. While this configuration is currently the preferred embodiment of the invention, it may be advantageous in some situations to further couple the motion of the arms, as is done in several of the following additional embodiments.

Figure 8:
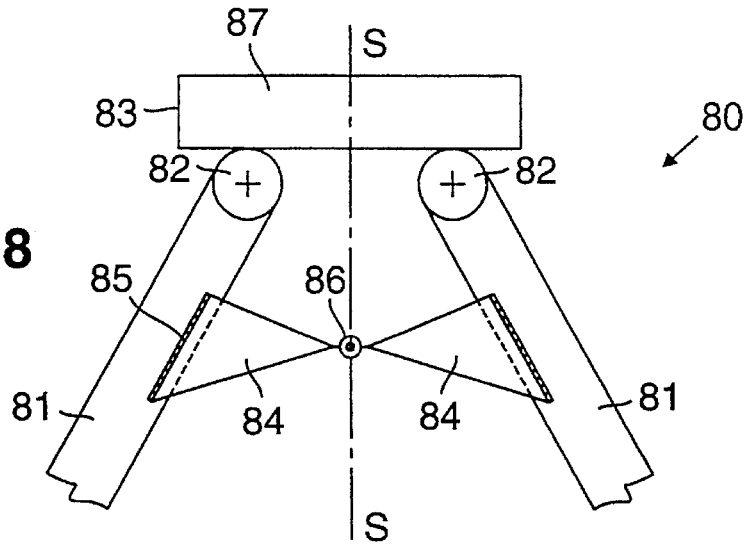
FIG. 8 is a partial schematic view of the hinge mechanism and arms of an embodiment of the invention having hinge plates.

FIG. 8 is a schematic plan view of the hinge mechanism 80 and arms 81 of another embodiment of the invention. The secondary hinges 82 are shown disposed perpendicular to the primary hinge 83, although they may be oriented at other angles. Flanges 84 are pivotally mounted to each arm, such as by piano hinges 85. The flanges 84 are rotatably mounted to each other, such as by a knuckle joint 86. The arms and flanges constrain the knuckle joint to move within the plane of symmetry S—S between the arms. Since the linkage formed by the primary bearing tube 87, the arms and the flanges is symmetrical, the arms must translate the same amount laterally. Consequently, the arms (and thus the handles) are forced to move symmetrically.

Alternatively, the hinges, flanges and knuckle joint may be constructed of a resilient material such as plastic, elastomer or rubber. For example, the knuckle joint may be a deformable rubber connector, or the hinges, flanges and knuckle may be a one-piece polymer part with reduced cross sections in the areas requiring flexure. Such embodiments encourage symmetric exercise strokes while permitting some left-to-right asymmetry.

Figure 9:
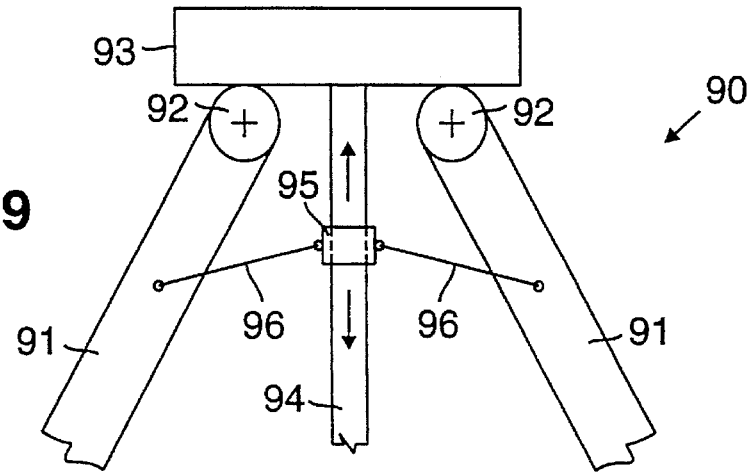
FIG. 9 is a partial schematic view of the hinge mechanism and arms of an embodiment of the invention having a slider link.

FIG. 9 is a schematic plan view of the hinge mechanism 90 and arms 91 of another embodiment of the invention. Again, the arms are operably engaged such that they must move symmetrically in the lateral direction. The secondary 92 hinges are again shown disposed perpendicular to the primary hinge 93, although other angles of attachment are possible. A slider rod 94 is fixedly mounted to the primary hinge 93. A slider ring 95 is mounted to the slider rod 94 and adapted to be displaceable along its length. Links 96 are pivotally mounted to the slider ring and to each arm 91. Consequently, as the arms are displaced laterally, the slider ring is caused to move along the slider rod. Due to their mutual connection to the slider ring, both arms are caused to move symmetrically about the secondary hinges.

Figure 10:
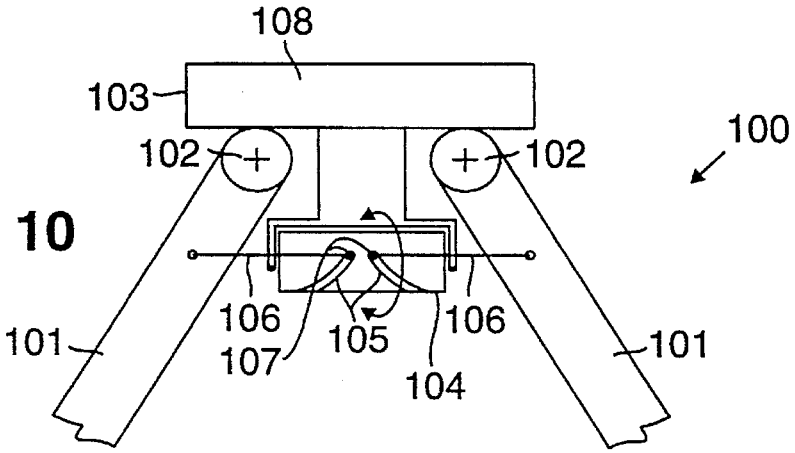
FIG. 10 is a partial schematic view of the hinge mechanism and arms of an embodiment of the invention having a cam link.

FIG. 10 is a schematic plan view of the hinge mechanism 100 and arms 101 of another embodiment of the present invention. The secondary hinges 102 are shown mounted perpendicularly to the primary hinge 103, although other attachment angles are possible. A barrel cam 104 having mirrored, grooved profiles 105 is mounted to the primary bearing tube 108 equidistant from both secondary hinges 102. The barrel cam is mounted for rotational movement. A rigid link 106 with a cam follower 107 is pivotally mounted to each arm. As an arm is moved outward, the barrel cam is forced to rotate about its axis, causing the other rigid link to force the other arm to move the same lateral distance.

Figure 11:
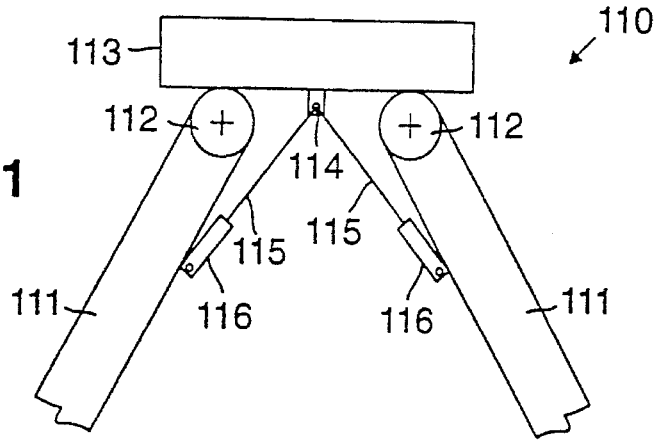
FIG. 11 is a partial schematic view of the hinge mechanism and arms of an embodiment of the invention having variable length links with resistance.

FIG. 11 is a schematic plan view of the hinge mechanism 110 and arms 111 of another embodiment of the invention. The secondary hinges 112 are shown mounted perpendicularly to the primary hinge 113, although other attachment angles are possible. An anchor 114 is rigidly mounted to the primary hinge between the secondary hinges 112. A variable length link 115 engages each arm 111 to the anchor. A resistance mechanism 116, such as a pneumatic, hydraulic, spring, elastic band, electrical or magnetic resistance, is operably engaged to the link 115 to resist any change is length. Consequently, the mechanism provides resistance to lateral movement of the arms 111 during the exercise stroke. Also, the resistance mechanism discourages quick, lateral movement of the arms. The mechanism 110 thus provides resistance to lateral movement both inward and outward, while encouraging a smooth stroke.

Figure 12:
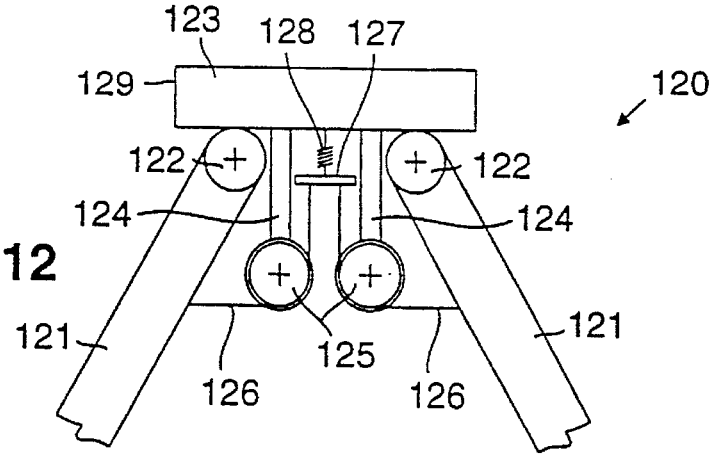
FIG. 12 is a partial schematic view of the hinge mechanism and arms of an embodiment of the invention having a spring pulley linkage.

FIG. 12 is a schematic plan view of the hinge mechanism 120 and arms 121 of another embodiment of the invention. The secondary hinges 122 are shown mounted perpendicular to the primary hinge 123. However, other orientations are possible. Branches 124 are fixedly mounted to the primary bearing tube 129. A pulley 125 is mounted on each branch and disposed in the same plane as its respective arm. Cables or belts 126 are attached to the arms 121, extend over the pulleys 125 and attach to a plate 127. The plate is attached to the primary bearing tube 129 by a resistance 128, which can be a spring, or can be another resistance device such as hydraulic, pneumatic, frictional or electromagnetic. As the arms are displaced laterally, the plate 127 is pulled from the primary hinge. This lateral movement is resisted by the resistance 128. The cables 126 could be attached to the arms 121 to resist outward movement, as shown, or to resist inward movement.

The plate 127 could be journalled in a track, or mounted on rails (not shown), such that the orientation of the plate with respect to the primary hinge is fixed. Consequently, as one arm is displaced laterally, the other arm is free to rotate the same lateral distance.

Figure 13A:
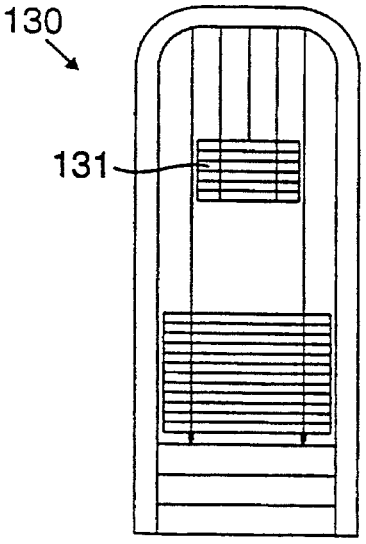
FIG. 13A is a front elevational view of the weight stacks of an embodiment of the invention having an auxiliary weight stack.
Figure 13B:
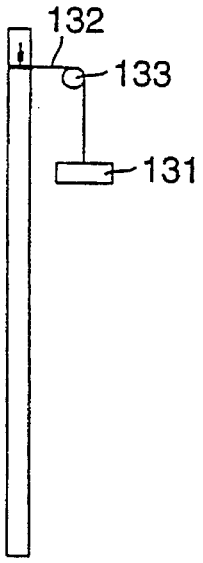
FIG. 13B is a side elevational view of the weight stacks of FIG. 13A.

FIG. 13A is a schematic front elevation view of the weight stacks 130 of an embodiment of the invention including an auxiliary weight stack 131. FIG. 13B is a side view of the weight stack with the auxiliary weight stack. In this embodiment, the spring 128 shown in FIG. 12 is replaced by a cable or belt 132. A pulley 133 is mounted on or near the primary hinge to direct the cable or belt for attachment to the auxiliary weight stack 131. Consequently, to move the arms laterally, the user must pull on the cable or belt, thereby lifting the auxiliary weight stack. The user thus has the freedom to select the resistance to the lateral movement of the hands. In another version of this embodiment, separate auxiliary weight stacks are provided to resist the lateral movement of each arm.

Figure 14:
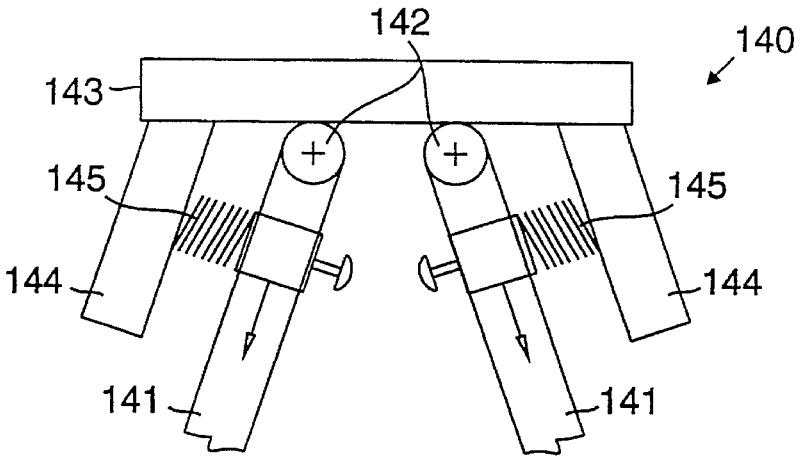
FIG. 14 is a partial schematic view of the hinge mechanism, arms and handles of an embodiment of the invention having incrementally adjustable handle resistance.

FIG. 14 is a schematic front view of a hinge mechanism 140 of another embodiment of the present invention. The secondary hinges 142 are shown disposed perpendicular to the primary hinge 143, although other orientations could be used. Rigid members 144 are mounted to the primary hinge 143 and disposed in the plane of rotation of the arms 141 about the secondary hinges 142. A resistance means 145, such as a spring, is operably engaged to each arm 141 and its respective rigid member 144. The resistance means resists the lateral movement of the arm outward. The resistance means may be disposed at different points along the arm and the rigid member to vary the lateral resistance. The shape of rigid member 144 or the angle of attachment of the rigid member to the primary hinge 143 may be chosen to further define the resistance profile as means 145 is moved along the arm. The angle of attachment may further be adjustable. The resistance means 145 may be attached to both the arm 141 and the member 144 to operate in both tension and compression, providing bidirectional resistance to lateral arm movement.

Figure 14A:
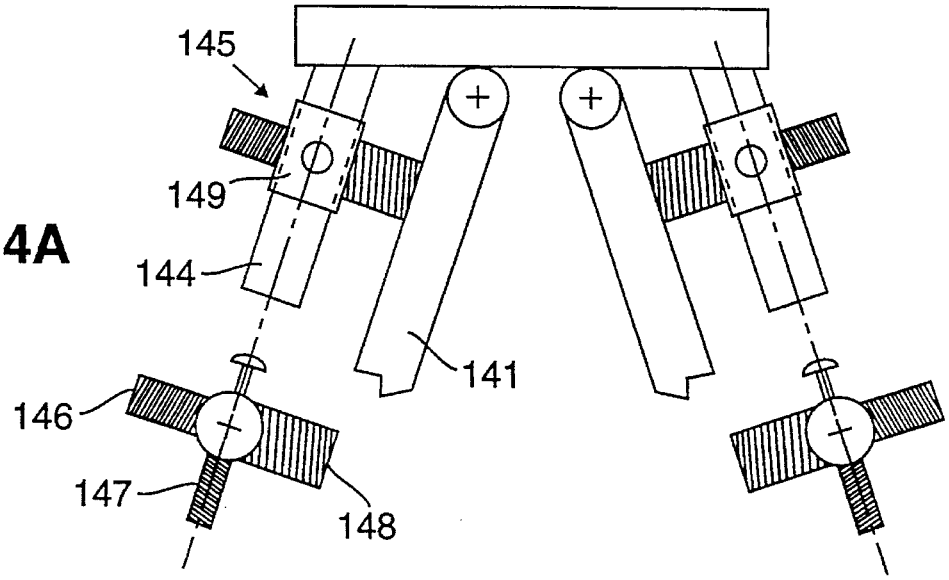
FIG. 14A is a partial schematic view of the hinge mechanism, arms and handles of an embodiment of the invention having discrete degrees of resistance.

FIG. 14A shows another embodiment or the hinge mechanism 140 of FIG. 14, with the resistance means 145 comprising a set of springs 146, 147, 148 mounted to a ring 149. The ring is rotatably mounted to the rigid member 144 such that each spring can be indexed into contact with the arm 141. Each spring 146–148 has a different spring constant and thus provides a different resistance to the lateral movement of the arms.

Figure 15:
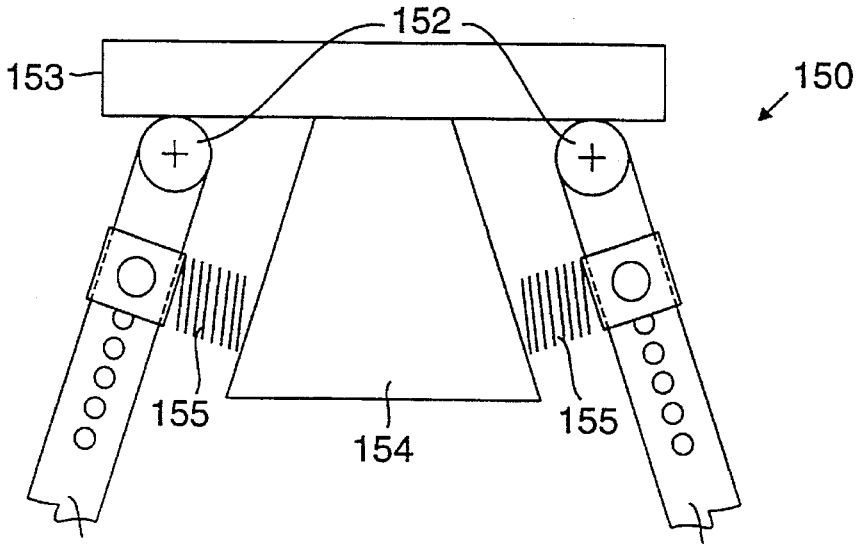
FIG. 15 is a partial schematic view of the hinge mechanism and arms of an embodiment of the invention having incrementally adjustable handle resistance.
Figure 15A:
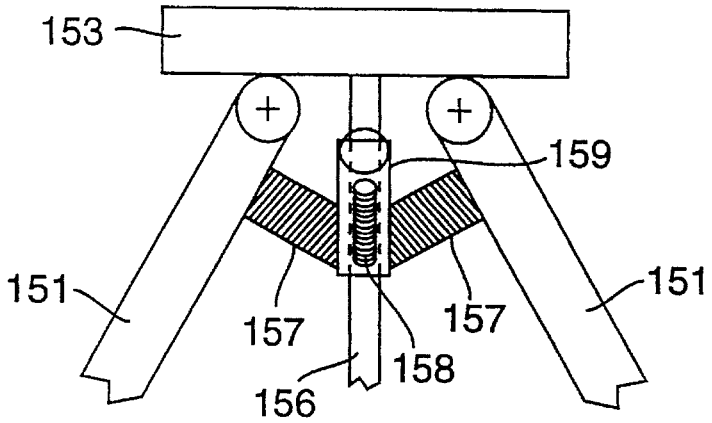
FIG. 15A is a partial schematic view of the hinge mechanism and arms of an embodiment of the invention having discrete levels of resistance.

FIG. 15 shows the hinge mechanism 150 and arms 151 of another embodiment of the present invention. The secondary hinges 152 are shown disposed perpendicular to the primary hinge 153. A central member 154 is mounted to the primary hinge 153 between the secondary hinges and disposed in the same plane as the arms 151. The angles or shape of the central member may be adjustable. A resistance means 155, such as a spring, is operably engaged to each arm 151 and the central member 154. The resistance means 155 resists the lateral movement of the arm toward the central member. This results in resistance to the lateral displacement of the handles (not shown) toward the center. The resistance means 155 may be moved by the user to different points along the arm and the central member to vary the resistance. Alternatively, a single spring could be mounted to each arm, thereby connecting the arms. FIG. 15A shows the hinge mechanism 150 of FIG. 15 with an alternative resistance means. The resistance means in this embodiment comprises spring pairs 157 and 158 mounted to a ring 159. The ring is rotatable about the rigid member 156 such that a different spring pair may be indexed into contact with the arms. Each spring pair 157 and 158 has a different spring constant and thus provides a different resistance to the lateral movement of the arms 151. The ring 159 may be made displaceable along the length of the rigid member 156 to additionally vary the resistance to lateral movement of the arms 151.

Figure 16:
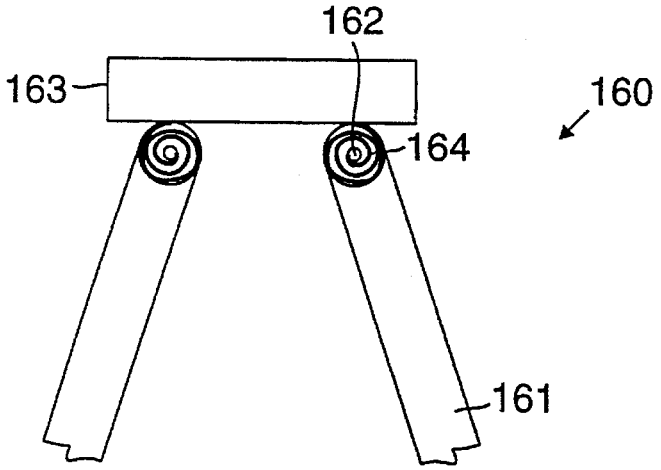
FIG. 16 is a schematic view of the hinge mechanism of an embodiment of the invention having torsion springs to resist lateral movement.

FIG. 16 is a front schematic view of the hinge mechanism 160 of another embodiment of the invention. The secondary hinges 162 are shown disposed perpendicular to the primary hinge 163, although other secondary hinge angles are possible. A torsion spring 164 is mounted to the primary hinge 163 near each secondary hinge 162 and operably engaged to the respective arm 161. The torsion spring resists the rotation of the arm about the secondary hinge. The torsion spring may be disposed to resist either inward movement of the arm or outward movement of the arm.

Figure 17:
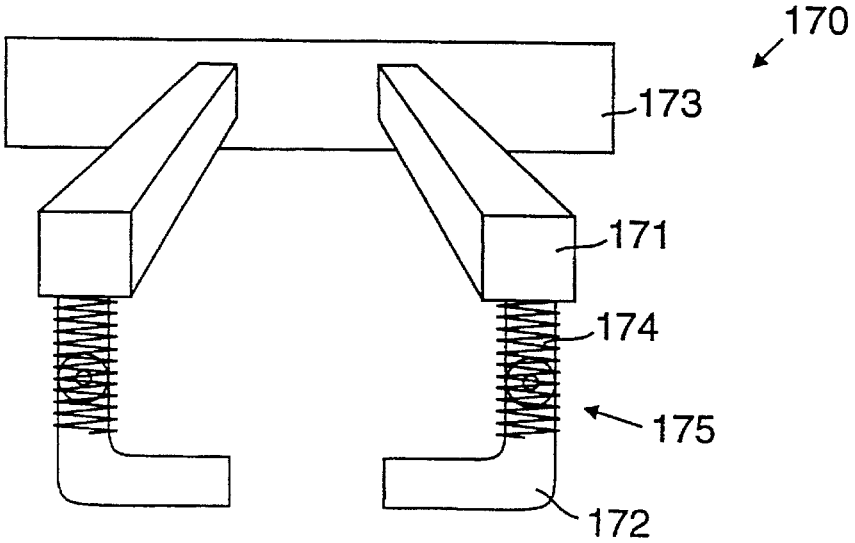
FIG. 17 is a schematic view of the hinge mechanism, arms and handles of an embodiment of the invention having a pivoting handgrip.

FIG. 17 is a schematic front view of the hinge mechanism 170, arms 171 and handles 172 of another embodiment of the invention. The arms 171 are directly mounted to the primary hinge 173. The handles 172 are pivotally mounted to the arms and adapted to rotate in a plane perpendicular to the arms about a handle peg 175. A spring 174, such as a torsion spring or other resistance mechanism, may resist the rotation of the handle 172 about the handle peg 175.

Figure 18:
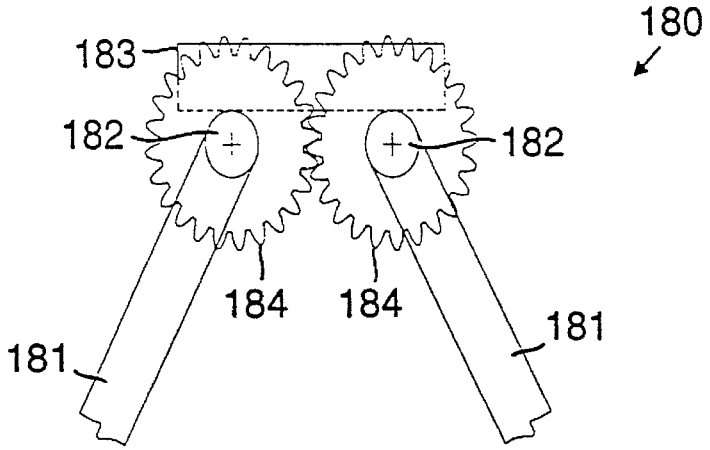
FIG. 18 is a partial schematic view of the hinge mechanism and arms of an embodiment of the invention having large gears.

FIG. 18 is a schematic plan view of the hinge mechanism 180 and arms 181 of another embodiment of the invention. The secondary hinges 182 are shown mounted perpendicular to the primary hinge 183, although other attachment angles are possible and still practice the invention. A large spur gear 184 is fixedly mounted to each arm 181 and adapted to rotate about its respective secondary hinge 182. The teeth of the large spur gears 184 engage each other such that the arms are caused to rotate about their respective secondary hinges together. Consequently, the handles and the user's hands are displaced symmetrically with respect to a central vertical plane. In the case where the secondary hinges are not perpendicular to the primary hinge, the large spur gears could be replaced by bevel gears.

Figure 19:
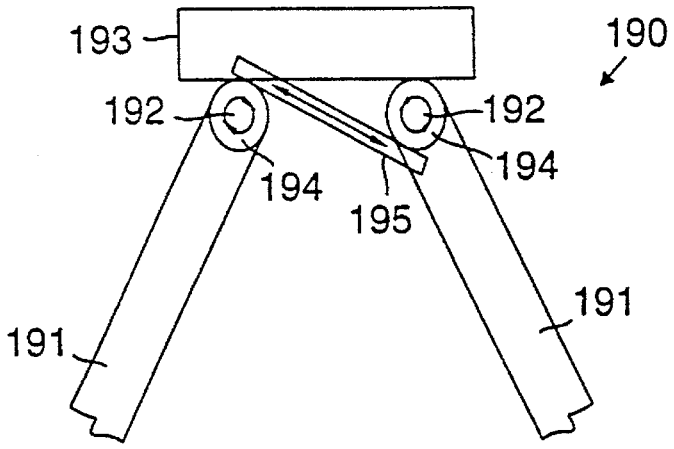
FIG. 19 is a partial schematic view of the hinge mechanism and arms of an embodiment of the invention having a rack and pinion link.

FIG. 19 is a schematic plan view of the hinge mechanism 190 and arms 191 of another embodiment of the invention. The secondary hinges 192 are shown mounted perpendicularly to the primary hinge 193, although other attachment angles are possible. Gears or pinions 194 are attached to each arm 191 and adapted to rotate about the secondary hinges 192 with the respective arm. A rack 195 is operably engaged to the pinions 194, forming a "rack and pinion" system which causes the arms to rotate about their respective secondary hinges 192 symmetrically. Consequently, the arms 191 are forced to move the same lateral distance.

Figure 20:
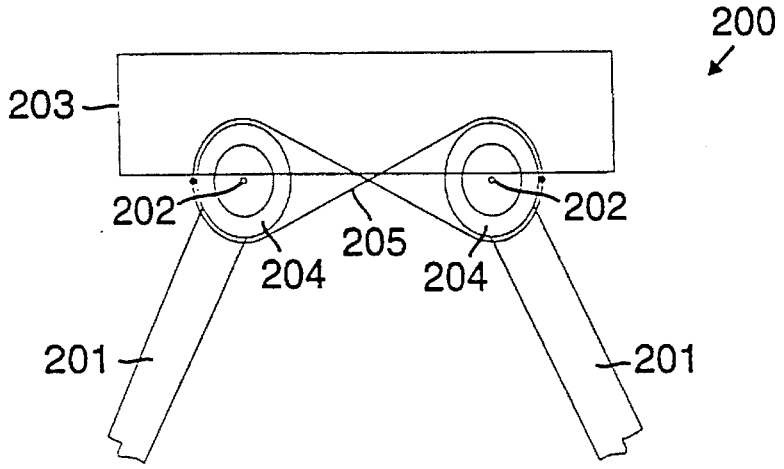
FIG. 20 is a partial schematic view of the hinge mechanism and arms of an embodiment of the invention having a belt and pulley link.

FIG. 20 is a schematic plan view of the hinge mechanism 200 and arms 201 of another embodiment of the invention. The secondary hinges 202 are shown disposed perpendicular to the primary hinge 203. The secondary hinges could be disposed at other orientations. A sprocket or pulley 204 is mounted on each secondary hinge 202 and adapted to rotate with the respective arms 201. A chain or belt 205 is looped about the pulleys in a "figure eight" configuration, causing the arms to rotate symmetrically in the lateral direction. Alternately, two chain or belt segments could be used, each following an S-shape, to form the figure eight. The belt may be non-deformable and require completely symmetrical movement of the arms, or may be made of an elastic material which would permit the arms to rotate asymmetrically but would encourage symmetrical movement.

FIG. 21 is a partial schematic plan view of the hinge mechanism 210, arms 211 and handles 212 of another embodiment of the invention. The arms are mounted directly to the primary hinge 213. The arms may be angled outward. Handle rods 214 are mounted at the ends of the arms distal to the primary hinge 213. A handle is slidingly mounted to each handle rod. The user is thus free to select the width of his hands during the exercise stroke, even changing the position of the hands. FIGS. 21A–21F show schematic end views of the hinge mechanism 210, in the plane 215 of the arms 211. As shown in FIG. 21A, the handle rod may be oriented within the plane of the arms, providing a neutral-resistance sliding motion of the handles 212. In this plane, the handle rod may be slanted up away from the arm, slanted down away from the arm or disposed horizontally. Further, the handles may be tilted backward from plane 215, as shown in FIG. 21B, or tilted forward of plane 215, as shown in FIG. 21C, thereby resisting handle movement inward or outward respectively, as this movement raises the arms and acts against the resistance.

As shown in FIGS. 21D, 21E and 21F, a resistance mechanism, such as springs 216–219, can be mounted to the handle rod 214 to oppose the movement of the handle 212 in the lateral direction. In the embodiment shown in FIG. 21D, the resistance mechanism 216 opposes movement of the handles 212 outward. As shown in FIG. 21E, the resistance mechanism 217, 218 opposes movement of the handles 212 both inward and outward. As shown in FIG. 21F, the resistance mechanism 219 opposes movement of the handles 212 inward. The resistance mechanisms 216–219 may be further supplemented by inclining the handle rods 214 as shown in FIGS. 21B and 21C.

Figure 22:
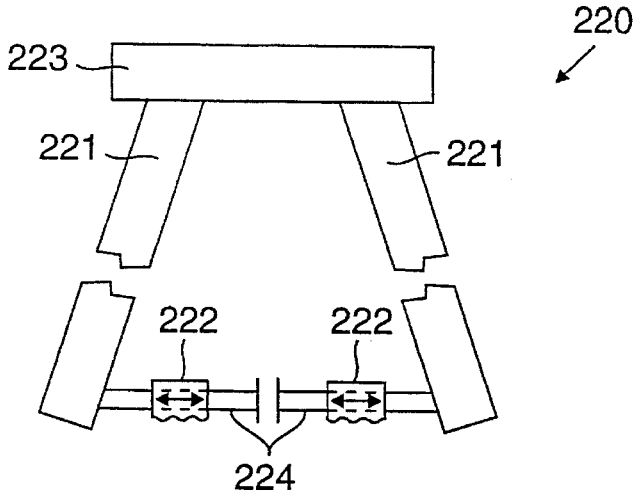
FIG. 22 is a partial schematic view of the hinge mechanism, arms and handles of an embodiment of the invention having inward sliding hand grips.
Figure 22A:
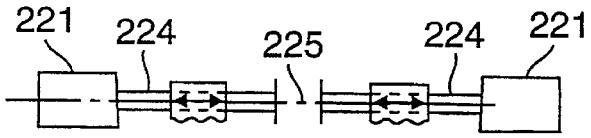
FIG. 22A is a partial schematic end view of the arms and handles of FIG. 22.
Figure 22B:
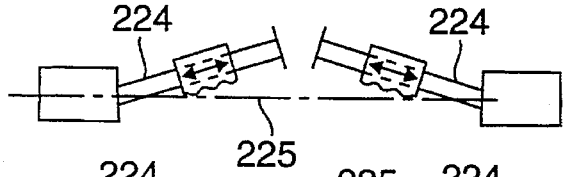
FIG. 22B is a partial schematic end view of the arms and handles of an embodiment of the invention having angled handle rods.
Figure 22C:
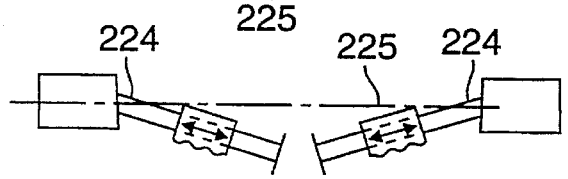
FIG. 22C is a partial schematic end view of the arms and handles of an embodiment of the invention having angled handle rods.

FIG. 22 is a front elevation view of the hinge mechanism 220, arms 221 and handles 222 of another embodiment of the invention. The arms 221 are mounted directly to the primary hinge 223. Preferably, the arms are angled outward. Handle rods 224 are mounted at the ends of the arms distal to the primary hinge and disposed on the interior side of the arms. A handle is slidingly mounted to each handle rod. The user is thus free to select the width of his hand position during the exercise stroke, and to vary the position of the hands throughout the exercise pattern. As shown in FIGS. 22A, 22B and 22C, the handle rod may be oriented within the plane 225 of the arms 221, or angled rearward from or forward of plane 225, to provide neutral, inward or outward resistance, respectively, to handle movement.

Figure 22D:
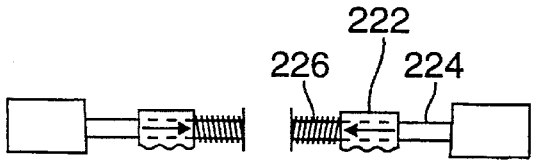
FIG. 22D is a partial schematic end view of the arms and handles of an embodiment of the invention having a handle rod resistance mechanism.
Figure 22E:
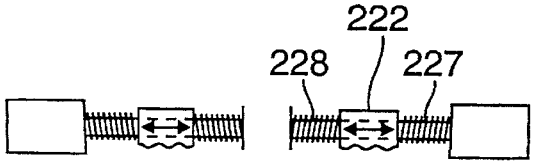
FIG. 22E is a partial schematic end view of the arms and handles of an embodiment of the invention having a handle rod resistance mechanism.
Figure 22F:
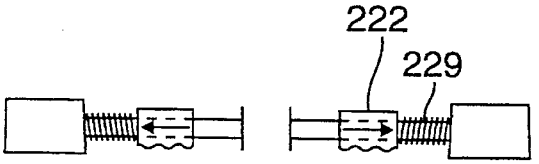
FIG. 22F is a partial schematic end view of the arms and handles of an embodiment of the invention having a handle rod resistance mechanism.

As shown in FIGS. 22D, 22E and 22F, a resistance mechanism, such as springs 226–229, can be mounted to the handle rod to oppose the movement of the handle in the lateral direction. As shown in FIG. 22D, the resistance mechanism 226 opposes movement of the handles 222 outward. As shown in FIG. 22E, the resistance mechanism 227, 228 opposes movement of the handles 222 both inward and outward. As shown in FIG. 22F, the resistance mechanism 229 opposes movement of the handles 222 inward. The resistance mechanisms 226–229 may be further supplemented by inclining the handle rods 224 as shown in FIGS. 22B and 22C.

Figure 23:
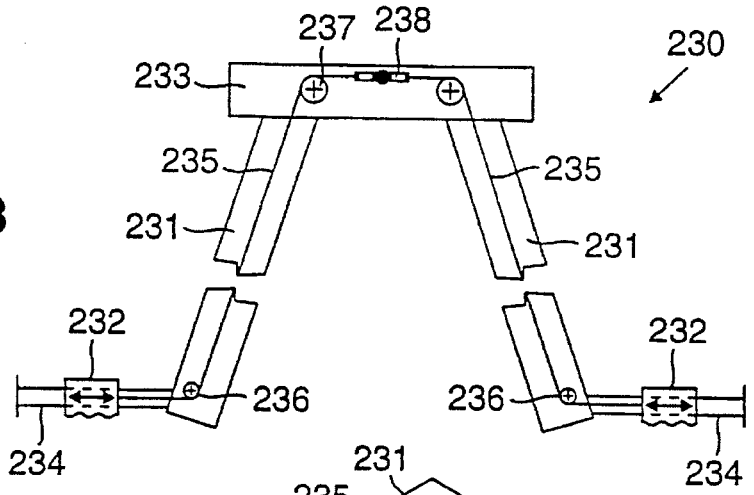
FIG. 23 is a partial schematic view of the hinge mechanism, arms and handles of an embodiment of the invention having sliding handles with cable resistance.
Figure 23A:
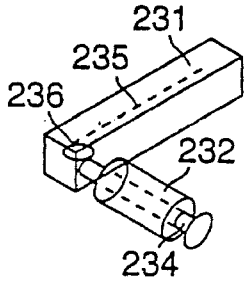
FIG. 23A is a partial detail perspective view of an arm and handle of the machine of FIG. 23.

FIG. 23 is a schematic front view of the hinge mechanism 230, arms 231 and handles 232 of another embodiment of the invention. The arms are mounted directly to the primary hinge. The arms may be angled outward. Handle rods 234 are mounted at the ends of the arms 231 distal to the primary hinge 233 and disposed on the exterior side of the arms. The handle rod may be oriented at a horizontal plane, tilted up away from the arm, or tilted down away from the arm. A handle 232 is slidingly mounted to each handle rod 234. A cable 235 is engaged to each handle and is directed, for example, by pulleys 236, 237 and 238 up to the primary hinge 233 and down to an auxiliary weight stack (see FIGS. 13A and 13B) such that the user may select the resistance to be provided to lateral movement of the arms. As shown in FIG. 23A, a detail view of the handle, the cable 235 is preferably disposed within the handle rod 234 and arm 231 to decrease the chance of the user contacting the cable. The handle rods 234 may alternatively be mounted to the interior side of the arm to provide resistance to inward motion of the arms. Further, the movement of the cables alternatively may be resisted by springs, friction, pneumatic, electric or magnetic resistance or other resistance mechanisms.

Figure 24:
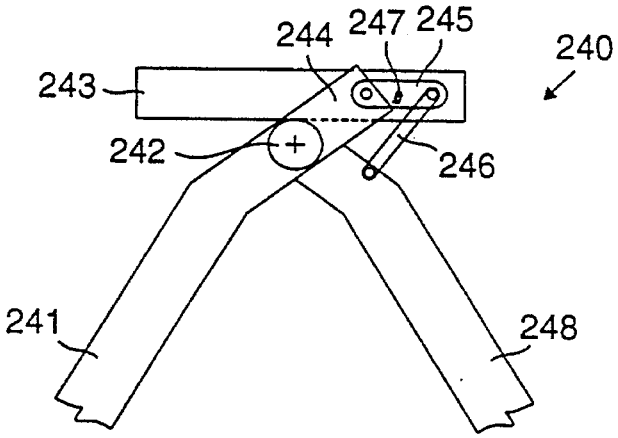
FIG. 24 is a partial schematic view of the hinge mechanism and arms of an embodiment of the invention having a pivoting bar linkage.

FIG. 24 is a schematic plan view of the hinge mechanism 240 and arms 241 and 248 of another embodiment of the invention. A single secondary hinge 242 is mounted perpendicular to the primary hinge 243. An extension 244 is attached to one of the arms 241 opposite the secondary hinge. A pivot plate 245 is slidingly and pivotally mounted at its center 247 to the primary hinge 243. The extension 244 is pivotally mounted to one end of the pivot plate 245. A rigid link 246 is pivotally mounted to the other end of the pivot plate 245 and to the other arm 248. A four-bar linkage is created by the extension 244, the portion of the second arm 248 near the primary hinge, the rigid link 246 and the pivot plate 245. Lateral displacement of one of the arms causes lateral displacement of the other in the opposite direction, via the four bar linkage.

Figure 25:
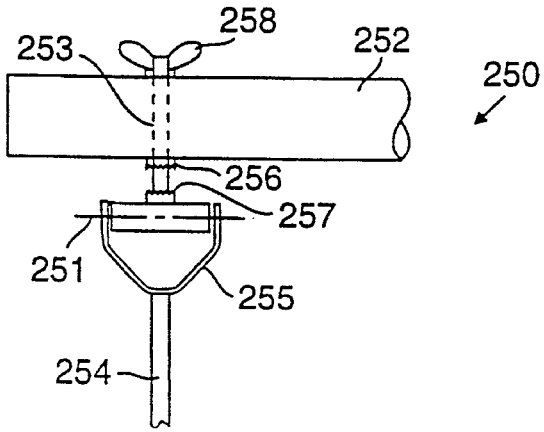
FIG. 25 is a schematic view of the hinge mechanism of an embodiment of the invention having an adjustable arm angle.

FIG. 25 is a partial schematic view of the hinge mechanism 250 of another embodiment of the present invention that permits the user to select the orientation of the secondary hinges to the primary hinge, respectively. Since the orientation of the secondary hinge to the primary hinge controls the resistance ratio of longitudinal to lateral resistance, the user can employ this embodiment to select a resistance ratio best suited to his exercise needs. The secondary hinges 251 (left secondary hinge only is shown) are mounted to the primary hinge 252 by a variable position rod 253. The arm 254 is mounted to the secondary hinge 251 by U-shaped member 255 which, in turn, is rotatably mounted to the secondary hinge. The orientation of the secondary hinge 251 to the primary hinge 252 is maintained by the engagement of notched or serrated surfaces 256 and 257 mounted to the secondary hinge and the primary hinge. To vary the orientation of the primary hinge to the secondary hinge, the notched surfaces are removed from engagement, such as by loosening a locking mechanism 258 such as a wing nut or cam lock. Once disengaged, the secondary hinge may be rotated to a desired position. The locking mechanism 258 is then tightened, engaging the notched surfaces and locking the secondary hinge in position with respect to the primary hinge. Preferably, both secondary hinges are disposed at the same orientation with respect to the primary hinge such that both arms will require the same force to be displaced laterally.

Figure 26:
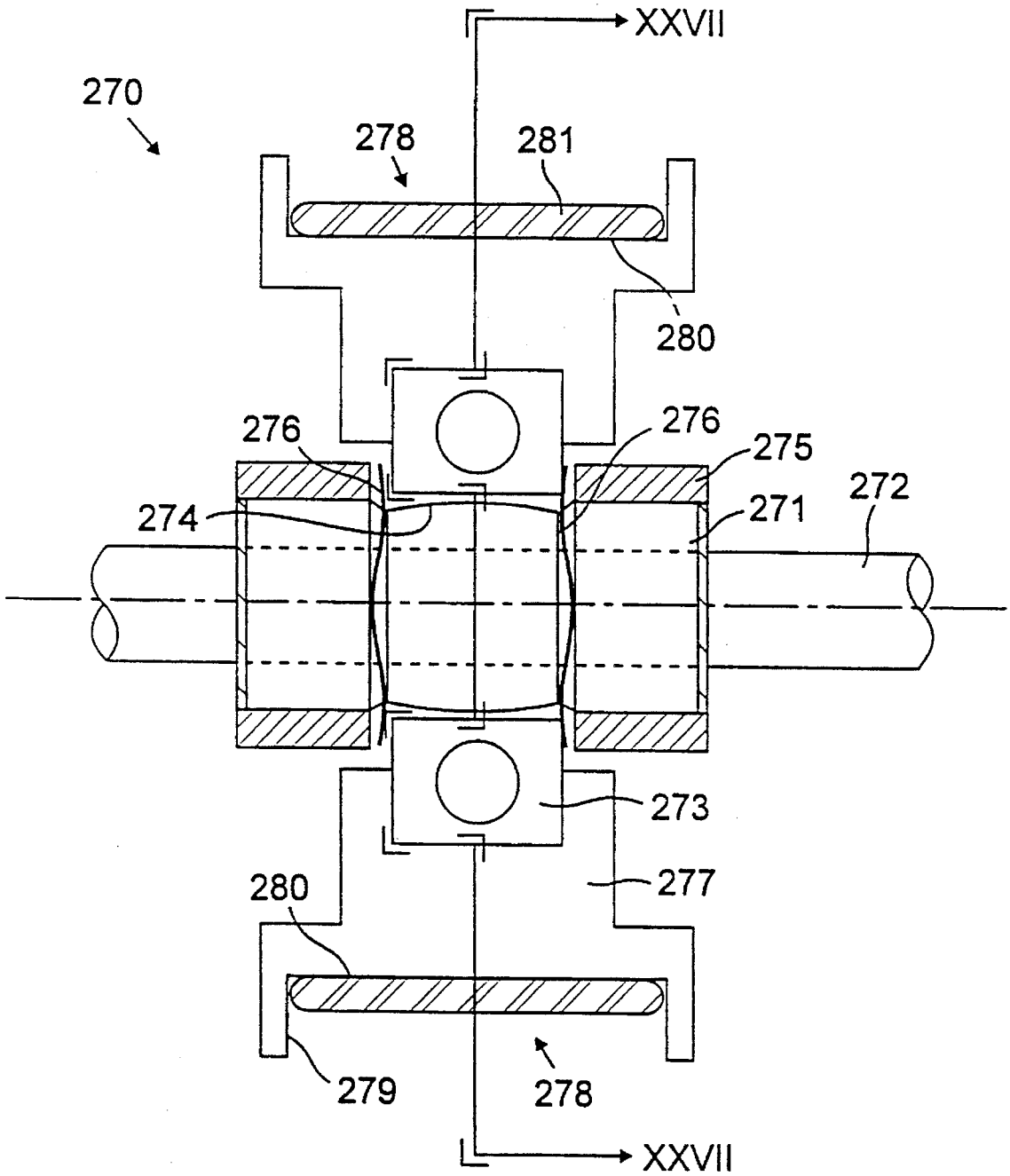
FIG. 26 is a cross-sectional view of a self-aligning pulley of the exercise machine of the invention.

FIG. 26 is a cross sectional view of a self-aligning pulley 270 for use with an exercise machine, such as the shoulder press machine of FIG. 1. The pulley is designed to align itself with the belt when either the frame or the belt is not perfectly aligned. Such a self-aligning pulley may be substituted for the traditional pulleys used as the weight stack pulleys 45*a* and 45*b* shown in FIG. 6.

Figure 27:
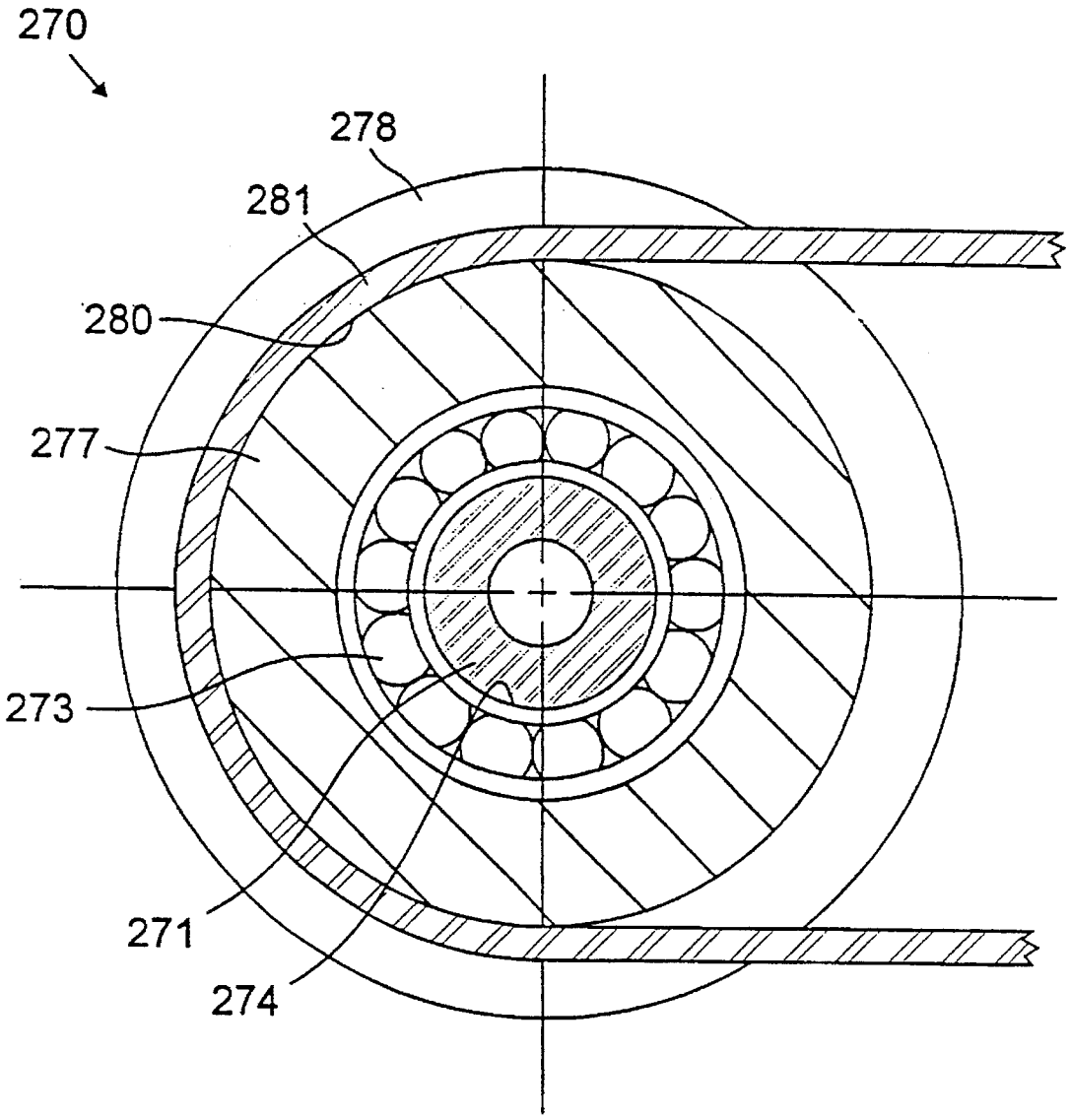
FIG. 27 is a cross sectional view of the pulley of FIG. 26, taken through section XXVII—XXVII.

FIG. 27 is a cross sectional view of the pulley 270 of FIG. 26, taken through section XXVII—XXVII. The self-aligning pulley 270 has a hub 277 mounted to a bearing 273. As shown in FIG. 26, a channel 278 having side walls 279 and a bottom 280 is disposed at the circumference of the hub 277 and adapted to accept a belt 281. In use, the belt should lie flat against the bottom of the channel. These elements are conventional.

In the self-aligning pulley 270 of FIG. 26, a shaft 271 having a novel design is mounted to the frame 272. The shaft 271 is preferably made from a mild tool steel such as SAE 1018. A bearing 273 is mounted over the shaft such that it is disposed symmetrically about the center of the shaft. The center of the shaft has a crowned portion 274 that presents a convex surface to the bearings. Spacers or locking rings 275 are disposed at the ends of the shaft 271 to prevent the bearing from slipping off the shaft. Alternatively, the shaft could be formed with integral flanges at each end. Wave washers 276, preferably made of hardened steel having some compressibility, are mounted to the shaft and disposed between each spacer 275 and the bearing 273. The wave washers bias the bearing away from the spacers and, thus, operate to urge the bearing toward the center of the convex surface. Other centering devices, such as O-rings, could be substituted for the wave washers. While the self-aligning pulley 270 is shown in FIG. 26 mounted to a cylindrical portion of frame 272, which is fitted to an internal diameter of the shaft 271, the frame could alternatively have bores fitted to the external diameters of the spacers 275 and still practice the invention.

Figure 28:
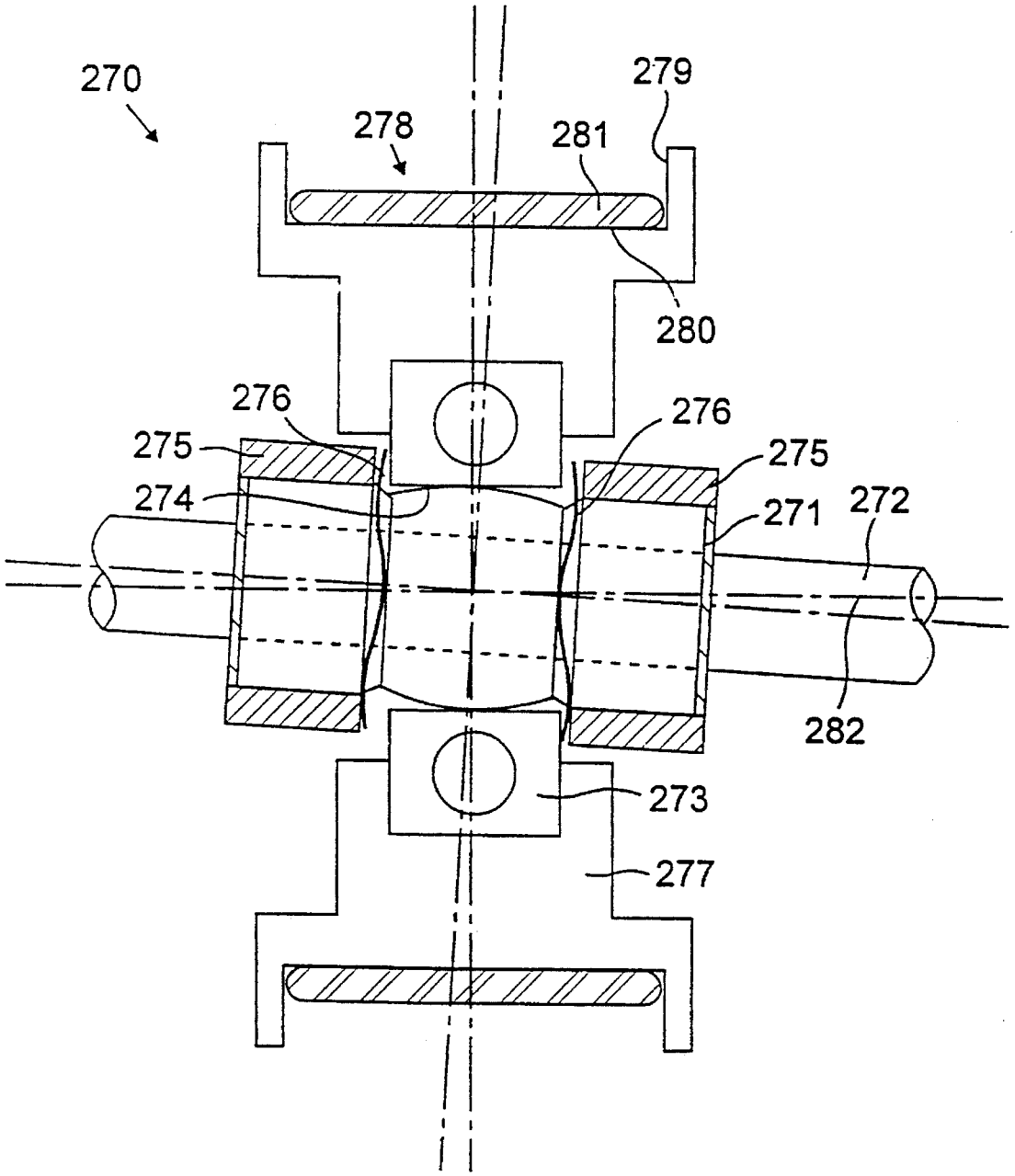
FIG. 28 is another cross-sectional view of the pulley in the same section as FIG. 26, showing a misaligned frame.

FIG. 28 is a cross sectional view of the self-aligning pulley 270 shown correcting for a misalignment. As shown, the frame 272 is misaligned from a horizontal axis 282. However, this apparatus would work equally well if the belt 281 were misaligned. If a traditional pulley were used, the belt 281 would ride, at least in part, on the side wall 279 of the channel 278. When the misalignment is severe, or over long periods of use, the belt would have a tendency to ride up over the side wall 279 completely, such that the belt would be completely out of the channel. The self-aligning pulley, however, compensates for misalignment by tilting about a plane extending through the center of the pulley. When misaligned, the belt 281 exerts a force on the pulley 270 that overcomes the bias of the wave washers 276 and causes the bearing 273 to slide over the crowned portion 274, resulting in the tilting of the pulley. The tilting of the pulley maintains the belt 281 in a flat position against the bottom 280 of the channel. The crowned portion 274, which is a surface of rotation, preferably maintains the pulley in a symmetrical position with respect to the center of the shaft so that the pulley will tilt, rather than simply slide.

By compensating for belt misalignment, the self-aligning pulley 270 reduces maintenance costs by minimizing edge wear on the belt 281 and by reducing side loads on the bearing 273. Furthermore, the self-aligning pulley can reduce manufacturing costs by permitting increased alignment tolerances without sacrificing belt life and smoothness of operation.

The foregoing is in no way a limitation on the scope of the invention which is defined by the following claims:

I claim:

1. An apparatus for performing a shoulder press comprising:

a frame having a front end and a rear end;

a seat mounted to the front end of the frame;

a backrest mounted to the frame and disposed above the seat;

a primary bearing tube rotatably mounted to the frame which primary bearing tube is rotatable about a primary axis and disposed above the seat;

a bracket rigidly mounted to the primary bearing tube;

a secondary bearing tube rotatably mounted to the bracket which secondary bearing tube is rotatable about a secondary axis wherein the primary axis and the secondary axis are skew;

an arm rigidly mounted to the secondary bearing tube;

a handle mounted to the arm distal to the secondary bearing tube and positioned in front of the backrest and directly above the seat;

a weight slidingly mounted to the frame at the front of the frame;

a lever mounted to the primary bearing tube; and a tether assembly having a first end and a second end wherein the first end is attached to the lever and the second end is attached to the weight.

2. The apparatus of claim 1 further comprising a self-aligning pulley mounted to the frame wherein the tether is journaled over the pulley between the lever and the weight.

3. The apparatus of claim 1 wherein the weight is slidable from an initial position to a raised position further comprising a fine tune adjustment comprising:

a first finger having a tip mounted to the frame proximate to the weight; and a second finger having a tip mounted to the weight wherein the tips are adjacent when the weight is in the initial position.

4. A method for exercising muscles of the upper torso of a user with an apparatus having a primary hinge mounted to a frame, a secondary hinge mounted to the primary hinge, in a skew orientation an arm mounted to the secondary hinge, a seat mounted to the front end of the frame, a backrest mounted to the frame and disposed above the seat, a handle mounted to the arm distal from the secondary hinge and positioned in front of the backrest and directly above the seat and a resistance mechanism operably engaged to the primary hinge, the method comprising:

sitting on the seat with the back resting against the backrest;

grasping the handle;

pushing the handle upward;

selecting a path of handle motion having a lateral motion component and a longitudinal motion component;

rotating the primary hinge; and overcoming the resistance provided by the resistance mechanism.

5. The method of claim 4 wherein the step of pushing the handle includes rotating the secondary hinge.

6. The method of claim 5 wherein the step of rotating the secondary hinge influences the step of rotating the primary hinge.

7. The method of claim 4 wherein the step of overcoming the resistance comprises:

overcoming resistance to the lateral motion component; and overcoming resistance to the longitudinal motion component.

8. A shoulder press apparatus for exercising the muscles of the upper torso of a user comprising:

a frame having a front end and a rear end;

a seat mounted to the frame at the front end;

a backrest mounted to the front end of the frame and disposed above and in back of the seat;

a primary hinge mounted to the frame and disposed above the seat which primary hinge has a primary axis of rotation;

a secondary hinge mounted to the primary hinge which secondary hinge has a secondary axis of rotation, said secondary axis of rotation being skew to said primary axis of rotation;

an arm mounted to the secondary hinge wherein the arm can be displaced from an initial position;

a handle mounted to the arm distal to the secondary hinge and positioned in front of the backrest at about shoulder level when the arm is in the initial position; and means for resisting the displacement of the arm.

9. The apparatus of claim 8 wherein the secondary hinge is a first secondary hinge, the arm is a first arm and the handle is a first handle, further comprising:

a second secondary hinge mounted to the primary hinge;

a second arm mounted to the second secondary hinge wherein the second arm can be displaced from an initial position;

and a second handle mounted to the second arm distal to the second secondary hinge.

10. The apparatus of claim 9 further comprising means for constraining the displacement of the arms such that the first arm and the second arm move symmetrically.

11. The apparatus of claim 8 wherein the resistance means comprises a weight connected to the frame and slidable from a starting position to a raised position further comprising a fine tune adjustment including:

a first finger having a tip mounted to the frame proximate to the weight; and a second finger having a tip mounted to the weight wherein the tips are adjacent when the weight is in the starting position.

12. The apparatus of claim 8 wherein the resistance means comprises a tether connecting the primary hinge to a displacable weight further comprising a self-aligning pulley mounted to the frame wherein the tether is journaled over the self-aligning pulley between the primary hinge and the weight.

13. A shoulder press apparatus for exercising the muscles of the torso of a user by resisting displacement of the user's limb comprising:

a frame;

means for engaging the user's limb such that upward displacement of the user's limb causes displacement of the engagement means;

means for mounting the engagement means to the frame for rotation about at least two axes, said at least two axes being skew in relation to one another so as to provide a lateral resistance component to the displacement of the engagement means;

a weight stack displacably mounted to the frame; and means for connecting the engagement means to the weight stack such that upward displacement of the engagement means causes displacement of the weight stack.

14. A shoulder press apparatus for exercising the muscles of the upper torso of a user comprising:

a frame;

a seat mounted to the frame;

a backrest mounted to the frame above and behind the seat;

a primary hinge mounted to the frame behind the backrest;

a left secondary hinge mounted proximate to the primary hinge in a skew orientation;

a left arm mounted to the left secondary hinge;

a right secondary hinge mounted proximate to the primary hinge in a skew orientation; and a right arm mounted to the right secondary hinge.

15. The apparatus of claim 14 further comprising:

a right flange rotatably mounted to the right arm;

a left flange rotatably mounted to the left arm; and a knuckle joint rotatably connecting the right flange to the left flange.

16. The apparatus of claim 14 further comprising at least one weight connected to at least one arm.

17. The apparatus of claim 14 further comprising at least one weight connected to the primary hinge.

18. The apparatus of claim 17 wherein the at least one weight is connected to the primary hinge by a belt extending over a self-aligning pulley.

19. The apparatus of claim 14 wherein the left secondary hinge is rotatably mounted to the primary hinge at a first selected orientation and the right secondary hinge is rotatably mounted to the primary hinge at a second selected orientation.

20. The apparatus of claim 19 further comprising a first toothed plate mounted to the left secondary hinge and a second toothed plate mounted to the primary hinge.

21. The apparatus of claim 14 further comprising:

a slide rod mounted to the primary hinge;

a slide ring mounted to the slide rod and adapted to slide along the length of the slide rod;

a left link pivotally mounted to the left arm and pivotally mounted to the slide ring;

a right link pivotally mounted to the right arm and pivotally mounted to the slide ring; and a weight operably engaged to the primary hinge for resisting rotation of the primary hinge.

22. The apparatus of claim 14 further comprising:

a barrel cam rotatably mounted to the primary hinge and disposed between the arms;

a left link pivotally mounted to the left arm and operably engaged to the barrel cam by a cam follower;

a right link pivotally mounted to the right arm and operably engaged to the barrel cam by a cam follower wherein the lateral displacement of an arm causes the barrel cam to rotate which, in turn, causes the other arm to be displaced an equal lateral distance; and a weight operably engaged to at least one arm for resisting rotation of the primary hinge.

23. The apparatus of claim 14 further comprising:

a left gear fixedly mounted to the left arm; and a right gear fixedly mounted to the right arm wherein the left gear and the right gear are operably engaged such that the right arm and the left arm rotate the same amount about their respective secondary hinges.

24. The apparatus of claim 23 further comprising a rack gear which is operably engaged to the left gear and the right gear.

25. The apparatus of claim 23 further comprising right teeth mounted at the periphery of the right gear and left teeth mounted at the periphery of the left gear wherein the right teeth are directly engaged to the left teeth.

26. The apparatus of claim 23 further comprising a belt operably engaged to the left gear and the right gear.

27. The apparatus of claim 14 further comprising at least one torsion spring fixedly mounted to the primary hinge and at least one arm.

28. The apparatus of claim 14 further comprising:

an anchor mounted to the primary hinge; and at least a first variable-length link pivotally mounted to at least one arm and pivotally mounted to the anchor such that the variable-length link changes length when the arm is rotated about its secondary hinge and a means for resisting the change in length of the first variable-length link.

* * * * *